US007926914B2

(12) United States Patent
Sugahara

(10) Patent No.: US 7,926,914 B2
(45) Date of Patent: Apr. 19, 2011

(54) LIQUID DROPLET TRANSPORTING APPARATUS, AND VALVE, MEMORY, DISPLAY UNIT USING THE LIQUID DROPLET TRANSPORTING APPARATUS

(75) Inventor: Hiroto Sugahara, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 1055 days.

(21) Appl. No.: 11/729,761

(22) Filed: Mar. 29, 2007

(65) Prior Publication Data

US 2007/0285447 A1 Dec. 13, 2007

(30) Foreign Application Priority Data

Mar. 31, 2006 (JP) ..... 2006-097263

(51) Int. Cl.
*B41J 2/06* (2006.01)

(52) U.S. Cl. ..... 347/55; 347/45; 347/54

(58) Field of Classification Search ..... 347/14, 347/19, 44, 45, 47, 54, 55, 61–65, 84–87
See application file for complete search history.

(56) References Cited

U.S. PATENT DOCUMENTS 7,264,337 B2 * 9/2007 Lee et al. ..... 347/55
7,311,374 B2 * 12/2007 Oomura ..... 347/19
2004/0055891 A1 3/2004 Pamula et al.
2004/0196525 A1 10/2004 Fujii et al.
2005/0219330 A1 10/2005 Sugahara
2006/0001705 A1 1/2006 Sugahara
2006/0024207 A1 2/2006 Sugahara
2006/0054503 A1 3/2006 Pamula et al.
2006/0120879 A1 6/2006 Sugahara
2006/0245979 A9 11/2006 Sugahara
2007/0001034 A1 1/2007 Sugahara
2007/0024669 A1 2/2007 Sugahara

FOREIGN PATENT DOCUMENTS

EP 1 621 344 2/2006
JP 2004-252444 9/2004
JP 2005-257569 9/2005

* cited by examiner

*Primary Examiner* — Juanita D Stephens
(74) *Attorney, Agent, or Firm* — Frommer Lawrence & Haug LLP

(57) ABSTRACT

A liquid droplet transporting apparatus includes a first electrode which is arranged on a surface of a substrate, a second electrode which is arranged apart from the first electrode on the surface of the substrate, an insulating layer which is arranged to cover each of the first electrode and the second electrode, and a liquid repellent property on a surface of the insulating layer changes according to an electric potential difference between the electrode and an electroconductive liquid droplet on the surface, and a third electrode which cooperates with the second electrode to detect the liquid droplet on the second electrode. Consequently, it is possible to transport a liquid droplet between two areas, and also to detect as to in which area out of the two areas, the liquid droplet exists.

18 Claims, 28 Drawing Sheets

LIQUID DROPLET TRANSPORTING APPARATUS, AND VALVE, MEMORY, DISPLAY UNIT USING THE LIQUID DROPLET TRANSPORTING APPARATUS

CROSS REFERENCE TO RELATED APPLICATION

The present application claims priority from Japanese Patent Application No. 2006-097263, filed on Mar. 31, 2006, the disclosure of which is incorporated herein by reference in its entirety.

BACKGROUND OF THE INVENTION

1. Field of the Invention

The present invention relates to a liquid droplet transporting apparatus which transports a liquid droplet by using an electrowetting phenomenon, a valve, a memory, and a display unit.

2. Description of the Related Art

A technology of transporting a liquid droplet by using a phenomenon in which a liquid repellent property (wetting angle) on a surface of an insulating layer when an electric potential difference is generated on both sides of the insulating layer is changed (electrowetting phenomenon) has hitherto been known. For example, a micro liquid droplet (very small size liquid droplet) transporting device described in Japanese Patent Application Laid-open No. 2005-257569 includes two electrodes (a first electrode and a second electrode) provided to be isolated on a surface of a substrate, a dielectric film which covers the first electrode, and a hydrophobic (water repellent) film (insulating layer) which covers surfaces of the dielectric film and the second electrode continuously. In this liquid droplet transporting device, when a voltage is applied between the two electrodes with a liquid droplet positioned between the two electrodes while making a contact with both areas at which the two electrodes are arranged, a wetting angle of a surface of the hydrophobic film in the area at which the first electrode is arranged and the dielectric film is formed becomes smaller than a wetting angle of a surface of the hydrophobic film in the area at which the second electrode is arranged and the dielectric film is not formed. Therefore, a difference in the wetting angle becomes a driving force, and the liquid droplet is transported from the second electrode to the first electrode in one direction.

The micro liquid droplet transporting device described in Japanese Patent Application Laid-open No. 2005-257569 moves the liquid droplet from one electrode to the other electrode in one direction. On the other hand, apart from such apparatus, also an apparatus which transports a very micro liquid droplet between two areas in which electrodes are arranged has been desired in various fields. In this case, when it is possible to detect as to which area among the two areas the liquid droplet exists, such an apparatus would be highly applicable markedly.

SUMMARY OF THE INVENTION

An object of the present invention is to provide a liquid droplet transporting apparatus which is capable of transporting a liquid droplet between to areas by using an electrowetting phenomenon, and which is also capable of detecting as to which area among the two areas the liquid droplet exists. It should be noted that parenthesized reference numerals assigned to elements shown below are only examples of the elements, and are not intended to limit the elements.

According to a first aspect of the present invention, there is provided a liquid droplet transporting apparatus including: a first electrode (22) which is arranged on a surface (10*b*) of a substrate (10*a*); a second electrode (23) which is arranged apart from the first electrode on the surface of the substrate, an insulating layer (24) which is arranged to cover both the first electrode and the second electrode, and in which a liquid repellent property on a surface thereof changes according to an electric potential difference between the first and second electrodes (the first electrode 22 or the second electrode 23) and an electroconductive liquid droplet (21) on the surface; and a third electrode (23*b*) which cooperates with the second electrode to detect a presence of the liquid droplet on the second electrode.

According to the liquid droplet transporting apparatus of the present invention, by making the electric potential of the first electrode and the electric potential of the second electrode to be different, it is possible to change the liquid repellent property (wetting angle) on the surface of the insulating layer covering the first electrode and the second electrode. Consequently, it is possible to transport the liquid droplet between an area at which the first electrode is arranged and an area at which the second electrode is arranged, from an area of a higher liquid repellent property to an area of a lower liquid repellent property. In other words, it is possible to transport the liquid droplet between the two areas by a simple structure made of the two electrodes (first electrode and the second electrode) and the insulating layer.

In the present invention, the "area at which the first electrode is arranged" means an area of the insulating layer, overlapping with the first electrode, and the "area at which the second electrode is arranged" means an area of the insulating layer, overlapping with the second electrode.

Furthermore, since the third electrode is provided which cooperates with the second electrode to detect the presence of the liquid droplet on the second electrode, when the electroconductive liquid droplet exists on the second electrode, it is possible to detect a predetermined electrostatic capacitance between the second electrode and the third electrode. On the other hand, when the electroconductive liquid droplet does not exist on the second electrode, a detected value of the electrostatic capacitance between the second electrode and the third electrode is less than the predetermined value (of the electrostatic capacitance). Consequently, by detecting the electrostatic capacitance between the second electrode and the third electrode, it is possible to judge whether or not the liquid droplet exists on the second electrode. As a result of this, it is possible to detect whether the liquid droplet exists on the area at which the first electrode is arranged or on the area at which the second electrode is arranged.

In the liquid droplet transporting apparatus (20) of the present invention, at least one of the first electrode (22) and the second electrode (23) may be divided as (into) at least two split electrodes (23*a* and 23*b*) which are arranged to be mutually isolated, on the surface (10*b*) of the substrate (10*a*). In this case, when the electroconductive liquid droplet exists on the two split electrodes, it is possible to detect a predetermined electrostatic capacitance between the two split electrodes. On the other hand, when the electroconductive liquid droplet does not exist on the two split electrodes, the electrostatic capacitance between the two split electrodes is declined. Consequently, according to a possibility of detecting or not detecting the electrostatic capacitance between the two split electrodes, it is possible to judge (determine) whether or not the liquid droplet exists on the two split electrodes. In this case, one of the split electrodes may be the third electrode (23*b*).

The liquid droplet transporting apparatus (20) of the present invention may further include an electric-potential applying mechanism (25) which applies an electric potential to each of the first electrode (22) and the second electrode (23). The liquid droplet may be transported in the insulating layer (24) between portions thereof covering the first electrode and the second electrode respectively, by applying different electric potential to the first electrode and the second electrode respectively with the electric potential applying mechanism to reduce a liquid repellent property on the surface of the insulating layer at a portion among the portions covering one of the first and second electrodes to be lower than a liquid repellent property of another portion covering the other of the first and second electrodes. In this case, it is possible to transport the liquid droplet between the area at which the first electrode is formed and the area at which the second electrode is formed, by applying the different electric potential to each of the first electrode and the second electrode to reduce the liquid repellent property on the surface of the part of the insulating layer covering one electrode to be lower than the liquid repellent property of the portion of the insulating layer covering the other electrode.

In the liquid droplet transporting apparatus (20) of the present invention, the split electrodes (23*a* and 23*b*) may be arranged such that when the liquid droplet (21) is transported to an area in which the split electrodes are arranged, the liquid droplet is positioned between the split electrodes while making a contact with both of the split electrodes, and the liquid droplet transporting apparatus (20) may further include a liquid droplet position detector (26) which detects whether the liquid droplet exists on an area at which the first electrode is arranged or on an area at which the second electrode is arranged, based on an electrostatic capacitance between the split electrodes. In this case, when the electroconductive liquid droplet exists between the two split electrodes while making a contact with both the split electrodes, an electrostatic capacitance is generated between the two split electrodes and the liquid droplet, with the insulating layer sandwiched between the two split electrodes and the liquid droplet, and when the liquid droplet does not exist, the electrostatic capacitance is decreased. Therefore, by detecting the electrostatic capacitance between the two split electrodes, it is possible to detect whether the liquid droplet exists on the area at which the first electrode is arranged or on the area at which the second electrode is arranged.

In the liquid droplet transporting apparatus (20) of the present invention, ground electrodes (27) may be arranged on the surface (24*c*) of the insulating layer (24) at portions thereof covering the first electrode (22) and the second electrode (23) respectively. In this case, by keeping the liquid droplet in contact with the ground electrode (27) and maintaining a predetermined electric potential, an electric potential difference between the electrode and the liquid droplet is stabilized. Consequently, it is possible to transport the liquid droplet assuredly.

In the liquid droplet transporting apparatus (20) of the present invention, the third electrode (124) may be isolated from the surface (10*b*) of the substrate (10), and may extend to face the second electrode (123). By arranging the third electrode in such manner, when the liquid droplet exists on the second electrode, it is possible to detect the electrostatic capacitance between the second electrode and the third electrode. On the other hand, when the liquid droplet does not exist on the second electrode, the electrostatic capacitance which is detected is declined. Consequently, by measuring the electrostatic capacitance, it is possible to detect whether the liquid droplet exists on the area at which the first electrode is arranged or on the area at which the second electrode is arranged.

In the liquid droplet transporting apparatus (20) of the present invention, the third electrode (224) may extend to face the second electrode (123) and a part of the first electrode, and may be arranged as a ground electrode. In this case, even when the liquid droplet exists on the first electrode, or when the liquid droplet exists on the second electrode, the liquid droplet is always in contact with the third electrode, and is kept at a predetermined electric potential. Consequently, since the electric potential between the electrode and the liquid droplet is stable, it is possible to transport the liquid droplet assuredly. Furthermore, when the liquid droplet exists on the second electrode, it is possible to detect the electrostatic capacitance between the second electrode and the third electrode. On the other hand, when the liquid droplet does not exist on the second electrode, it is not possible to detect the predetermined electrostatic capacitance. Consequently, by measuring the electrostatic capacitance, it is possible to detect whether the liquid droplet exists on the area at which the first electrode is arranged or on the area at which the second electrode is arranged.

In the liquid droplet transporting apparatus (20) of the present invention, a first liquid repellent film (40) which always has a liquid repellent property not less than the liquid repellent property of the insulating layer (24) may be formed on the surface (10*b*) of the substrate (10*a*) at an area outside the first electrode (22) and the second electrode (23). In this case, it is possible to prevent the liquid droplet from moving abruptly out of a range of the electrodes, due to vibration of the liquid droplet, or the like. A liquid repellent property of the area outside the first electrode and the second electrode may be higher than the liquid repellent property of the insulating layer. In this case, the insulating layer covering the first electrode and the second electrode may extend up to the outer side of the first electrode and the second electrode, and form the first liquid repellent film, or the first liquid repellent film may be formed to be separate from the insulating layer, on the outer side of the first electrode and the second electrode.

In the liquid droplet transporting apparatus (20) of the present invention, between the first electrode (22) and the second electrode (23), a width of an area in which the first liquid repellent film (40) is absent may be locally narrowed. In this case, it is possible to prevent the liquid droplet from moving abruptly to an electrode on an opposite side, due to vibration of the liquid droplet, or the like.

In the liquid droplet transporting apparatus (20) of the present invention, a second liquid repellent film (41) which always has a liquid repellent property not less than the liquid repellent property of the insulating layer (24) may be formed in an area on the surface (10*b*) of the substrate (10*a*) at an area between the first electrode (22) and the second electrode (23). In this case, it is possible to prevent the liquid droplet from moving abruptly to the electrode on the opposite side, due to the vibration of the liquid droplet, or the like. Moreover, a liquid repellent property of the area between the first electrode and the second electrode may be higher than the liquid repellent property of the insulating film, and the second liquid repellent film may be formed between the first electrode and the second electrode by the insulating layer covering the first electrode and the second electrode, or the second liquid repellent may be formed to be separate from the insulating layer, between the first electrode and the second electrode.

In the liquid droplet transporting apparatus (20) of the present invention, a part of the second liquid repellent film (41) may be projected toward an area in which each of the first electrode and the second electrode is arranged. In this case, it is possible to transport the liquid droplet smoothly between the two areas at which the electrodes (the first electrode and the second electrode) are arranged, while preventing the liquid droplet from moving abruptly to the opposite side, due to the vibration of the liquid droplet, or the like.

The liquid droplet transporting apparatus (20) of the present invention may be provided to a valve (11). In the valve which includes the liquid droplet transporting apparatus of the present invention, a fluid passage (19) which has opening (19*a*) in an area at which the first electrode (22) is arranged, may be formed in the substrate (10*a*), the opening of the fluid passage may be closed by the liquid droplet (21) when the liquid droplet (21) exists in the area at which the first electrode is arranged, and the opening of the fluid passage may be opened when the liquid droplet exists in an area at which the second electrode (23) is arranged. In this case, it is possible to close the opening of the fluid passage by transporting the liquid droplet in the area at which the first electrode is arranged, and to open the opening of the fluid passage by transporting the liquid droplet to the area at which the second electrode is arranged. In other words, since the valve includes the liquid droplet transporting apparatus having a simple structure including the two electrodes and the insulating layer, it is possible to open and close the fluid passage.

The valve (11) including the liquid droplet transporting apparatus (20) of the present invention may be provided on an ink cartridge (5) including an ink accommodating space (12) which accommodates an ink (I), and an atmosphere-communication passage (19) which communicates the ink accommodating space (12) and an atmosphere. The atmosphere-communication passage may be opened and closed by transporting the liquid droplet (21) between the first electrode (22) and the second electrode (23). In this case, the atmosphere-communication passage is closed by transporting the liquid droplet to the first electrode when the ink is not supplied from the ink cartridge to a destination of supply, and the atmosphere-communication passage is opened by transporting the liquid droplet to the second electrode only when the ink is supplied. In other words, by (using) the liquid droplet transporting apparatus having a simple structure, it is possible to prevent effectively, the drying (thickening) of ink without causing an insufficiency of ink supply.

The valve (11) including the liquid droplet transporting apparatus (20) of the present invention may be provided on a cap (60) which covers an ink jetting surface (1*a*) of an ink-jet head (1) which jets the ink (I) on to a recording medium (P), and which includes a communication passage (65) which communicates with a space (64) defined by the ink jetting surface and the cap, and an outside of the cap, and the communication passage may be opened and closed by transporting the liquid droplet (21) between the first electrode (22) and the second electrode (23). With the cap mounted on the ink jetting surface of the ink jetting head, it is possible to prevent the drying of the ink by closing the communication passage of the cap by positioning the liquid droplet on the first electrode. On the other hand, at the time of putting and taking the cap on and off the ink jetting surface, it is possible to prevent a meniscus of a nozzle from being destroyed due to a pressure fluctuation in the space in the cap at the time of putting the cap on, by opening the communication passage by transporting the liquid droplet to the second electrode. In this manner, by (using) the liquid droplet transporting apparatus having a simple structure, it is possible to prevent the drying of the ink and the destruction of the meniscus.

The liquid droplet transporting apparatus (20) of the present invention may be provided to a memory (70). In the memory including the liquid droplet transporting apparatus of the present invention, the liquid droplet transporting apparatus may transport the liquid droplet (21) between the first electrode (22) and the second electrode (23) according to data to be stored in the memory. In this case, it is possible to transport the liquid droplet to any of an area at which the first electrode is arranged and an area at which the second electrode is arranged, according to the data to be stored in the memory. In other words, since the memory includes the liquid droplet transporting apparatus having a simple structure, it is possible to store a data of 1 bit. Moreover, since it is possible to detect whether the liquid droplet exists on the area at which the first electrode is arranged or on the area at which the second electrode is arranged, it is possible to distinguish and read the data which is stored. Furthermore, in the memory of the present invention, since a silicon substrate which is used in a normal semiconductor memory is not necessary (indispensable), it is possible to manufacture the memory at a low cost by using a substrate made of a material such as a synthetic resin.

In the display unit including a liquid droplet transporting apparatus (20) of the present invention, a cover plate (83) which is arranged to face the surface (81*a*) of the substrate (81), and which has a through hole (83*a*) which is formed at a position corresponding to the first electrode (22), the liquid droplet (21) may be a colored liquid, and the liquid droplet transporting apparatus may transport the liquid droplet between the first electrode and the second electrode (23) according to data displayed on the display unit. In this case, when the colored liquid droplet is transported to a position on the first electrode, the color of the liquid droplet is displayed upon being transmitted through the cover plate. On the other hand, when the liquid droplet is transported to a position on the second electrode, the color of the liquid droplet is blocked by the cover plate, and is not displayed. Consequently, it is possible to display desired characters, images, and the like by using the liquid droplet transporting apparatus having a simple structure. Moreover, in the display unit in which the liquid droplet transporting apparatus of the present invention is used, the liquid droplet is not moved from the position on the first electrode or the position on the second electrode, unless the electric potential applied to the first electrode and the electric potential applied to the second electrode are different. In other words, it is not necessary to supply an electric power all the time for maintaining the same display state. Consequently, it is possible to maintain the same display state without consuming the electric power.

In a display unit (80) including a liquid droplet transporting apparatus (20) of the present invention, the first electrode (22), a portion of the substrate (81) corresponding to the first electrode, and a portion of the insulating layer (24) corresponding to the first electrode may be all transparent, and at least one of a second electrode (23), a portion of the substrate corresponding to the second electrode, and a portion of the insulating layer corresponding to the second electrode may be non-transparent. In this case, since the first electrode, and the insulating layer and the substrate corresponding to the first electrode are transparent, when a colored liquid droplet is transported to an area at which the first electrode is arranged, a color of the liquid droplet is displayed. On the other hand, since at least one of the second electrode, and the second electrode and the substrate corresponding to the insulating layer is non-transparent (property which does not allow the light to pass through), when a colored liquid droplet is transported to an area at which the second electrode is arranged, the color of the liquid droplet is not displayed when viewed from a surface of the substrate on a side opposite to the electrode. Consequently, by transporting a colored droplet between a position of the first electrode and a position of the second electrode, it is possible to display desired characters, images, and the like.

According to a second aspect of the present invention, there is provided a valve (11) including: a substrate (10*a*) having a fluid passage (19) shich has an opening (19*a*) on a surface (10*b*) of the substrate; a first electrode (22) which is arranged on the surface of the substrate, at an area including the opening of the fluid passage; a second electrode (23) which is arranged apart from the first electrode on the surface of the substrate; and an insulating layer (24) which is arranged to cover both the first electrode and the second electrode, and in which a liquid repellent property on a surface thereof changes according to an electric potential difference between the first and second electrodes and an electroconductive liquid droplet on the surface; and the opening of the fluid passage is closed by transporting the liquid droplet to an area at which the first electrode is arranged, and the opening of the fluid passage is opened by transporting the liquid droplet to an area at which the second electrode is arranged.

According to the valve of the present invention, the liquid droplet is transported between an area at which the first electrode is arranged and an area t which the second electrode is arranged, by changing the liquid repellent property (wetting angle) on the surface of the insulating layer covering the first electrode and the second electrode, by changing an electric potential of the first electrode and the second electrode. Moreover, the opening of the fluid passage is closed by transporting the liquid droplet to the area at which the first electrode is arranged, whereas, the opening of the fluid passage is opened by transporting the liquid droplet to the area at which the second electrode is arranged. In other words, it is possible to open and close the fluid passage by a simple structure formed by the two electrodes and the insulating layer.

According to the present invention, there is provided an ink cartridge which includes the valve (11) of the present invention. In this case, it is possible to open and close an atmosphere-communication hole of the ink cartridge by the valve of the present invention. Consequently, it is possible to prevent effectively the drying of the ink, by closing the atmosphere-communication hole when the ink is not supplied from the ink cartridge to a destination of supply, and by opening the atmosphere-communication hole when the ink is supplied.

DETAILED DESCRIPTION OF THE PREFERRED EMBODIMENTS

First Embodiment

A first embodiment of the present invention will be described below. The first embodiment is an example in which the present invention is applied to a valve for opening and closing an atmosphere-communication hole, of an ink cartridge.

Figure 1:
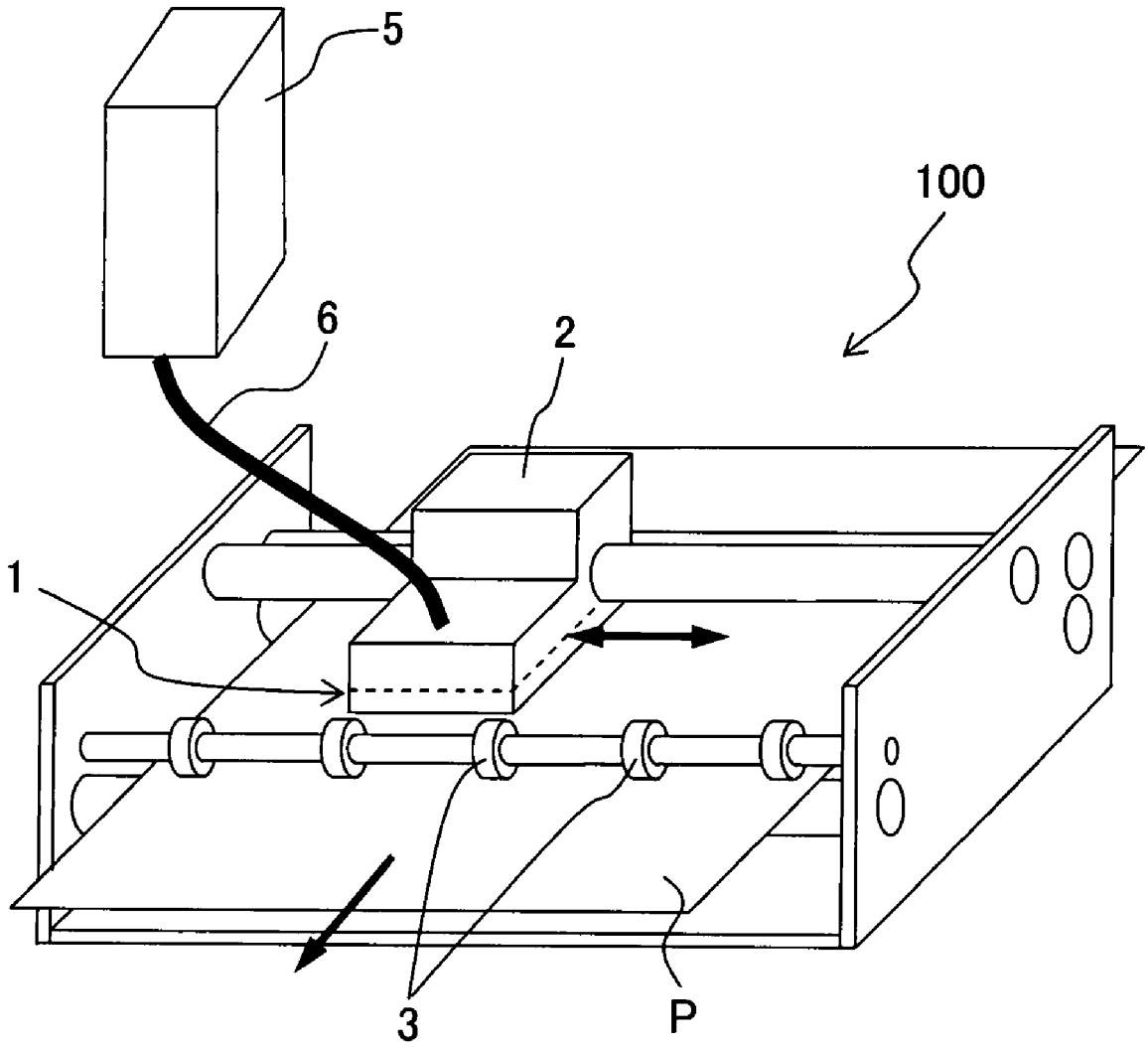
FIG. 1 is a schematic structural view of an ink-jet printer according to a first embodiment of the present invention.

Firstly, an ink-jet printer 100 in which an ink cartridge 5 is mounted will be described briefly. As shown in FIG. 1, the ink-jet printer 100 includes a carriage 2 which is movable in a left and right direction in FIG. 1, a serial ink-jet head 1 which is provided on the carriage 2 and discharges an ink onto a recording paper P, transporting rollers 3 which transport the recording paper in a frontward direction in FIG. 1, and a control unit 4 (refer to FIG. 4) which controls each component of the ink-jet printer 100.

The ink-jet head 1 is connected to the ink cartridge 5 which stores the ink, via a tube 6. Moreover, the ink-jet head 1 moves integrally with the carriage 2 in the left and right direction, and records desired characters, images, and the like on the recording paper P by jetting the ink from nozzles (omitted in the diagram) arranged on a lower surface thereof. Moreover, the recording paper P with the images and the like recorded thereon by the ink-jet head 1 is discharged in the frontward direction by the transporting rollers 3.

Figure 2:
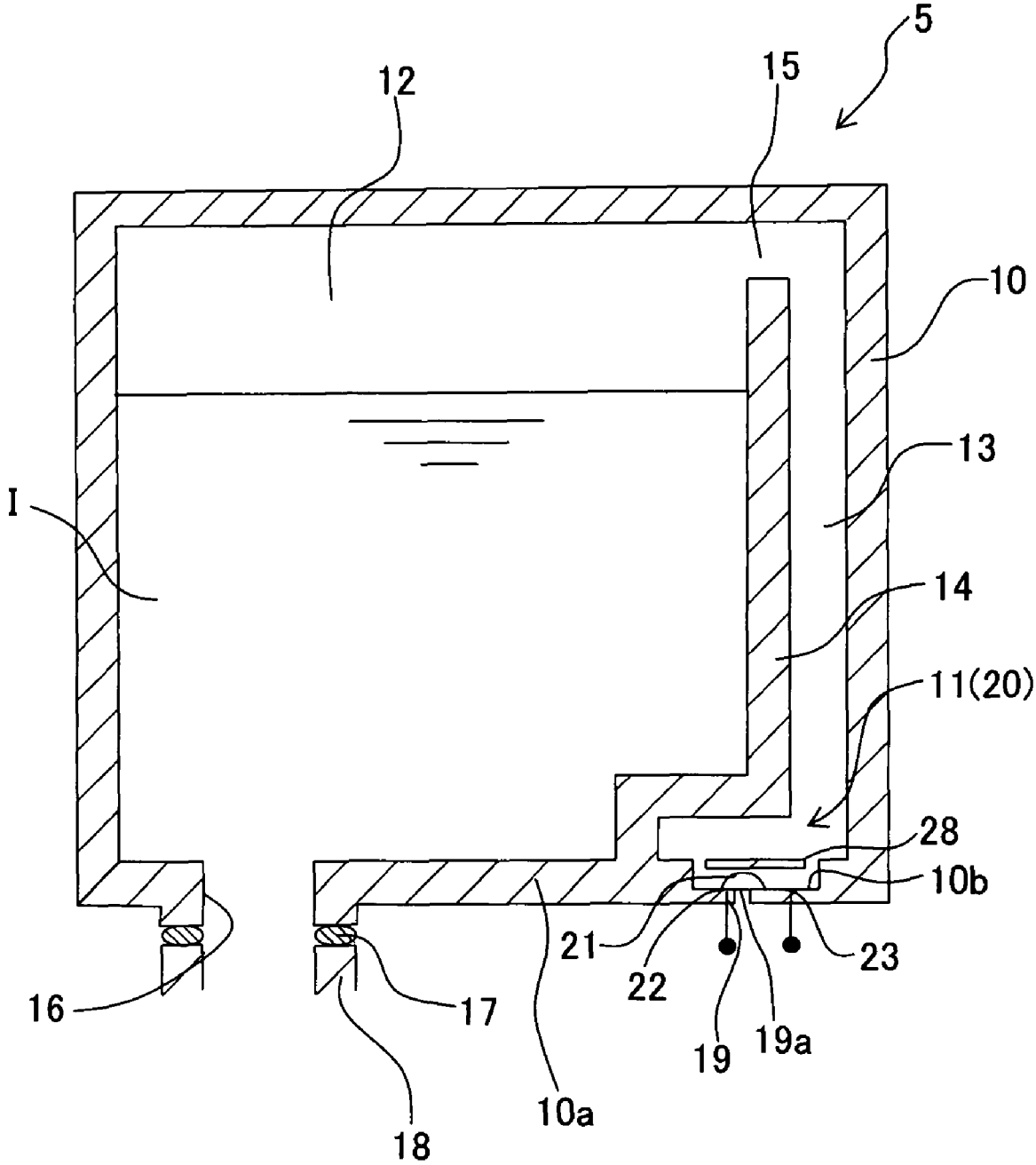
FIG. 2 is a vertical cross-sectional view of an ink cartridge.

Next, the ink cartridge 5 will be described. As shown in FIG. 2, the ink cartridge 5 includes a cartridge body 10 which has an ink accommodating space 12 and a valve 11 which opens and closes a atmosphere-communication hole 19 which communicates the ink accommodating space 12 and the atmosphere.

The cartridge body 10 is formed to be rectangular parallelepiped shape, of a synthetic resin material (such as polypropylene) having higher ink wettability. Moreover, the ink accommodating space 12 which accommodates an ink I, and an atmosphere-entering channel 13 which communicates with an upper portion of the ink accommodating space 12 are formed in the cartridge body 10. More concretely, the ink accommodating space 12 and the atmosphere-entering channel 13 are isolated by a partition wall 14 which extends from a bottom surface up to near a ceiling surface of the cartridge body 10, and communicate via a gap 15 between an upper edge of the partition wall 14 and the ceiling surface of the cartridge body 10.

The ink accommodating space 12 communicates with an ink supply hole 16 which is formed as a through hole in a bottom wall 10*a* of the cartridge body 10. Moreover, the ink supply hole 16 is connected to an ink supply pipe 18 of the ink-jet printer 100 via a sealing member 17. In other words, the ink I in the ink accommodating space 12 is supplied to the ink-jet head 1 via the ink supply hole 16 and the ink supply pipe 18.

The atmosphere-entering channel 13 communicates with the atmosphere-communication hole 19 (fluid passage, atmosphere-entering channel) which penetrates the bottom wall 10*a* of the cartridge body 10. Therefore, when the ink I in the ink accommodating space 12 is discharged (supplied to the ink-jet head 1), the atmosphere enters into an upper portion of the ink accommodating space 12 via the atmosphere-communication hole 19 and the atmosphere-entering channel 13. In order to prevent the ink I in the ink accommodating space 12 from drying and thickening as much as possible, the atmosphere-communication hole 19 is opened by the valve 11 only when the ink-jet printer 100 is used (at the time of an ink jetting operation of the ink-jet head 1), and is closed when the ink-jet printer 100 is not used. This will be described later in detail, together with the following description of the vale 11.

Next, the valve 11 will be described below. The valve 11 includes a liquid droplet transporting section 20 (liquid droplet transporting apparatus) which transports a liquid droplet 21 which is electroconductive, on an inner surface (upper surface) of the bottom wall 10*a* of the cartridge body 10, between two positions namely a position overlapping with an upper end opening 19*a* of the atmosphere-communication hole 19 (closing the opening 19*a*) and a position shifted away from the upper end opening 19*a*. Moreover, an arrangement is made such that by transporting the liquid droplet 21 between the two positions by the liquid droplet transporting section 20, an opening and closing of the atmosphere-communication hole 19 is switched. Furthermore, at an upper side of the liquid droplet transporting section 20, a protective section 28 which prevents an ink mist from falling directly on the electroconductive liquid droplet 21, is provided.

Here, as the liquid droplet 21 which is electroconductive, it is possible to use a liquid droplet 21 of a liquid such as water, and an aqueous solution in which glycerin or the like is dissolved. Or, it is also possible to use an ionic liquid (room temperature molten salt) made of only ions. Since this ionic liquid is nonvolatile in general, there is an advantage that it is hardly evaporated even when exposed to the atmosphere for a long time.

Figure 3A:
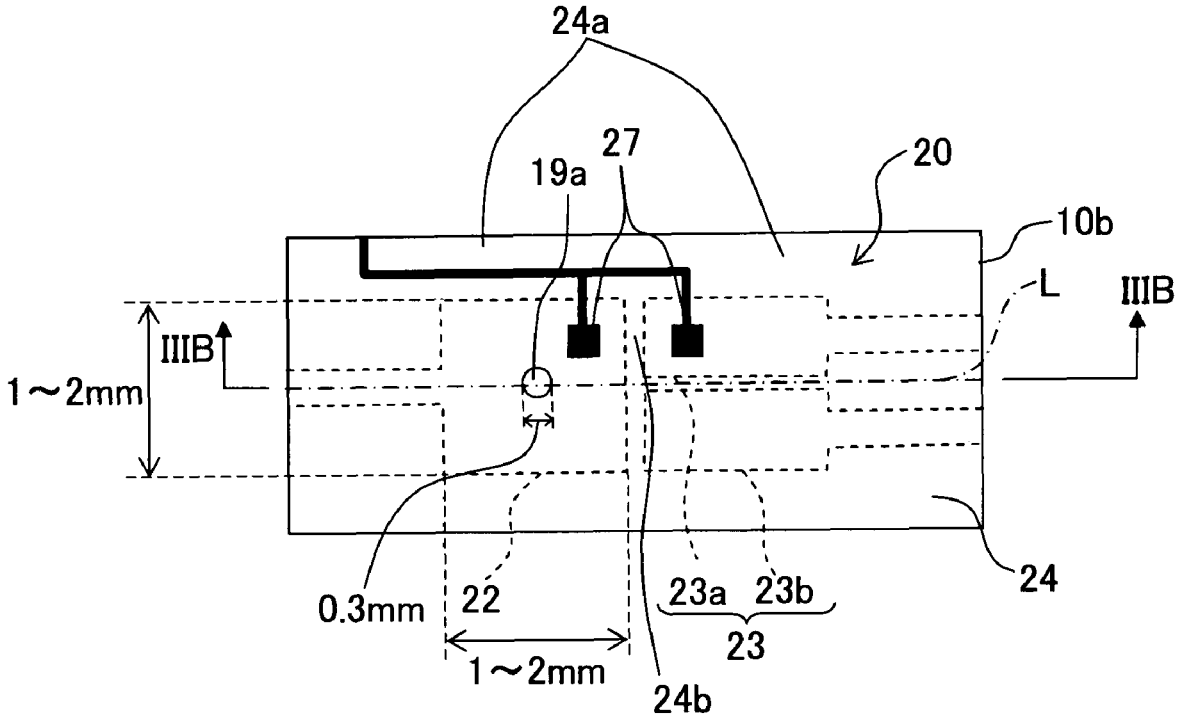
FIG. 3A is a plan view showing a liquid droplet transporting section of the first embodiment.
Figure 3B:
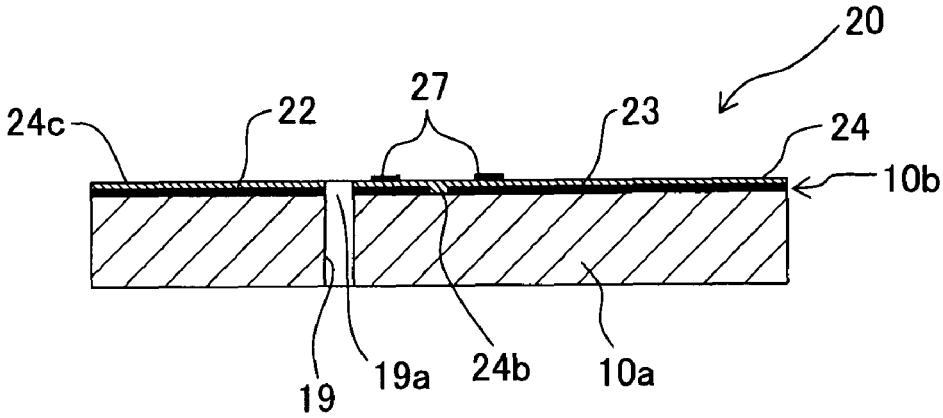
FIG. 3B is a cross-sectional view taken along a line IIIB-IIIB in FIG. 3A.

As shown in FIG. 3A and FIG. 3B, the liquid droplet transporting section 20 includes a first electrode 22 which is arranged on an upper surface of the bottom wall 10*a* of the cartridge body 10 made of a synthetic resin material, at an area which includes an upper end opening 19*a* of the atmosphere-communication hole 19, a second electrode 23 which is arranged on the upper surface of the bottom wall 10*a* same as the first electrode 22, apart from the first electrode 22, and an insulating layer 24 which is formed on the upper surface of the bottom wall 10*a*, to cover completely both the first electrode 22 and the second electrode 23.

The first electrode 22 has a substantially square and flat shape. Moreover, in a plan view, the upper end opening 19*a* of the atmosphere-communication hole 19 is positioned at almost center of the first electrode 22. Consequently, when the liquid droplet 21 exists in an area at which the first electrode 22 is arranged, the atmosphere-communication hole 19 is closed assuredly (completely) by the liquid droplet 21 (refer to FIG. 6A and FIG. 6B). In the present invention the "area at which the first electrode is arranged" means an area on the insulating layer, overlapping with the first electrode. In this embodiment, a length of one side of the first electrode 22 is approximately 1 mm to 2 mm, and a diameter of the upper end opening 19*a* is approximately 0.3 mm. In order that the liquid droplet 21 does not flow into the atmosphere-communication hole 19, it is preferable that a wetting angle of an inner surface of the atmosphere-communication hole 19 is not less than 90 degrees.

Figure 3C:
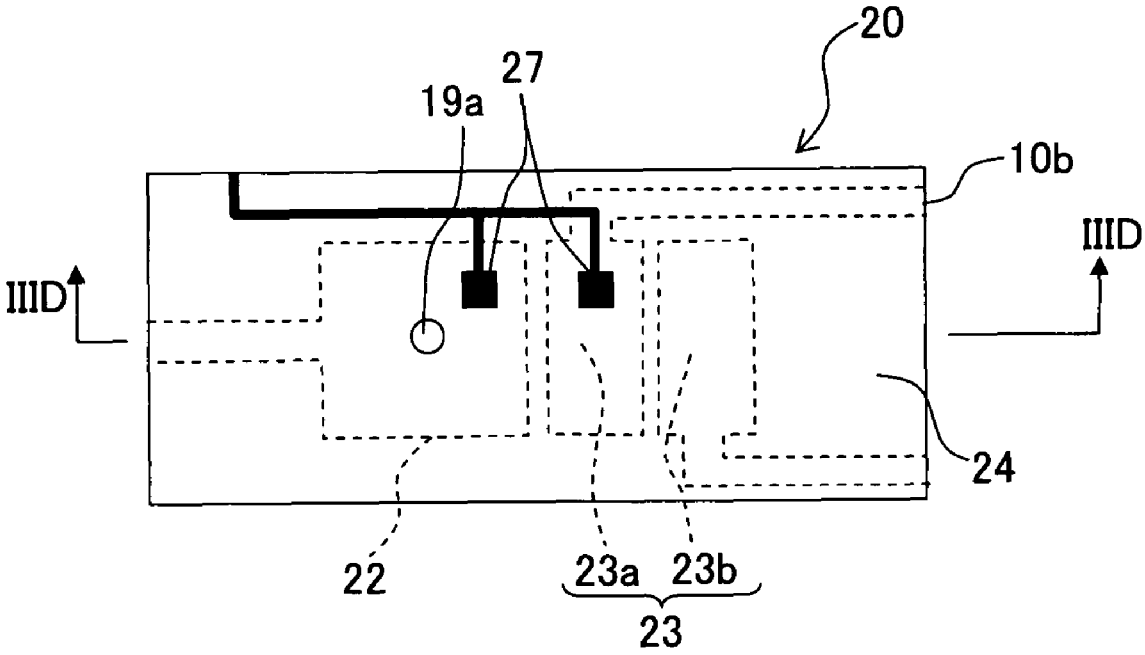
FIG. 3C is a plan view showing a modification of an arrangement direction of split electrodes in FIG. 3A.
Figure 3D:
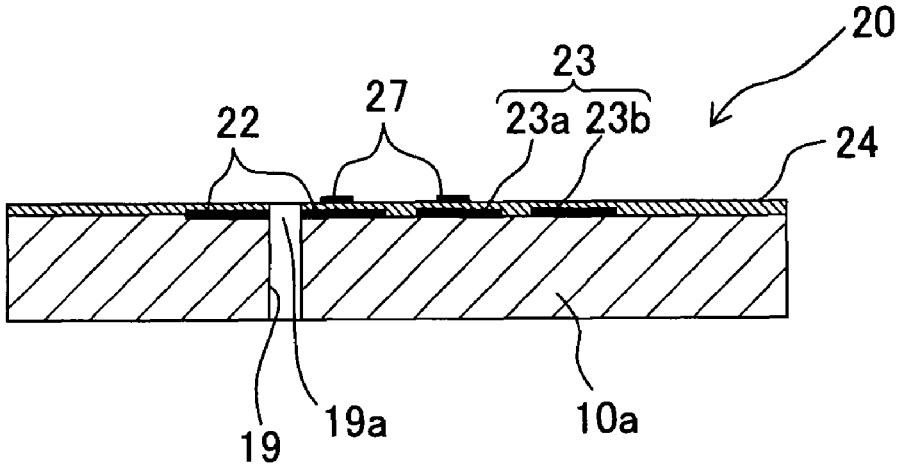
FIG. 3D is a cross-sectional view taken along a line IIID-IIID in FIG. 3.

Moreover, the second electrode 23 also has a substantially square and flat shape similarly as the first electrode 22, and is arranged on a right side of the first electrode 22 in FIG. 3A, apart from the first electrode 22. Furthermore, the second electrode 23 is divided into two split electrodes 23*a* (second electrode) and 23*b* (third electrode) of the same shape arranged to be isolated mutually. The two split electrodes 23*a* and 23*b* are arranged symmetrically with respect to a straight line L which passes through a center of gravity of the first electrode 22 and a center of gravity of the second electrode 23. The two split electrodes 23*a* and 23*b*, as shown in FIG. 3C and FIG. 3D, may be arranged in a direction same as the direction in which the first electrode 22 and the second electrode 23 are arranged. In other words, the second electrode 23 may be divided in a direction orthogonal to a direction in which the first electrode 22 and the second electrode 23 are arranged. In this embodiment, a length of one side of the second electrode 23 is approximately 1 mm to 2 mm.

Moreover, with the ink-jet cartridge 5 mounted on the ink-jet printer 100, the first electrode 22, and the two split electrodes 23*a* and 23*b* of the second electrode 23 are connected independently to an electric potential applying section 25 (electric potential applying mechanism, refer to FIG. 4) which is provided in the ink-jet printer 100, and a predetermined electric potential is applied to these electrodes 22 and 23 (23*a* and 23*b*) from the electric potential applying section 25. The electric potential applying section 25 applies the same electric potential simultaneously to the two split electrodes 23*a* and 23*b* which form the second electrode 23.

The insulating layer 24 is a thin film having a comparatively higher liquid repellent property, which is made of a material such as a fluororesin, a polyimide resin, and an epoxy resin. Moreover, the insulating layer 24 is formed on an entire predetermined area of an inner surface of the bottom wall 10*a*, which includes an area at which the first electrode 22 is arranged and an area at which the second electrode 23 is arranged. In other words, as shown in FIG. 3A and FIG. 3B, the insulating layer 24, in addition to the area at which the first electrode 22 is arranged and the area at which the second electrode 23 is arranged, is also formed in an area 24*a* outside the first electrode 22 and the second electrode 23 (first liquid repellent film), and also formed in an area 24*b* between the first electrode 22 and the second electrode 23 (second liquid repellent film). In the present invention, the "area at which the second electrode is arranged" means an area on the insulating layer, overlapping with the second electrode.

With the electroconductive liquid droplet 21 existing on a surface of the insulating layer 24, when an electric potential difference occurs between the liquid droplet 21 and the electrode (the first electrode 22 or the second electrode 23), the larger the potential difference becomes, the lower the liquid repellent property (wetting angle) on the surface of the insulating layer 24 becomes (electrowetting phenomenon).

Therefore, the electric potential applying section 25 is structured to apply different electric potential to each of the first electrode 22 and the second electrode 23, based on a command from the control unit 4 (valve control section 31) of the ink-jet printer 100, and the liquid droplet 21 is transported between the two areas by letting to differ the liquid repellent property of the insulating layer 24 between the area at which the first electrode 22 is arranged and the area at which the second electrode 23 is arranged.

To describe more concretely, the electric potential applying section 25 applies to one of the first electrode 22 and the second electrode 23, a predetermined electric potential which is not a ground electric potential, and applies to the other electrode of the first electrode 22 and the second electrode 23, the ground electric potential. Consequently, the liquid repellent property on a surface of a portion of the insulating layer 24 covering one of the electrodes to which the predetermined electric potential is applied is declined to be lower than the liquid repellent property of a portion covering the other electrode to which the ground electric potential is applied, and the liquid droplet 21 moves from the area at which the other electrode is arranged, to the area at which the one of the electrodes is arranged.

As shown in FIG. 3A and FIG. 3B, two ground electrodes 27 are arranged on a portion of the insulating layer 24 covering the first electrode 22 and the second electrode 23, and these two ground electrodes 27 are kept all the time at the ground electric potential. Moreover, since the liquid droplet 21 which exists on the area at which the first electrode 22 is arranged or the area at which the second electrode 23 is arranged makes a contact with the ground electrode 27, the electric potential of the liquid droplet 21 is kept at the ground electric potential and is not fluctuated (changed).

Figure 5:
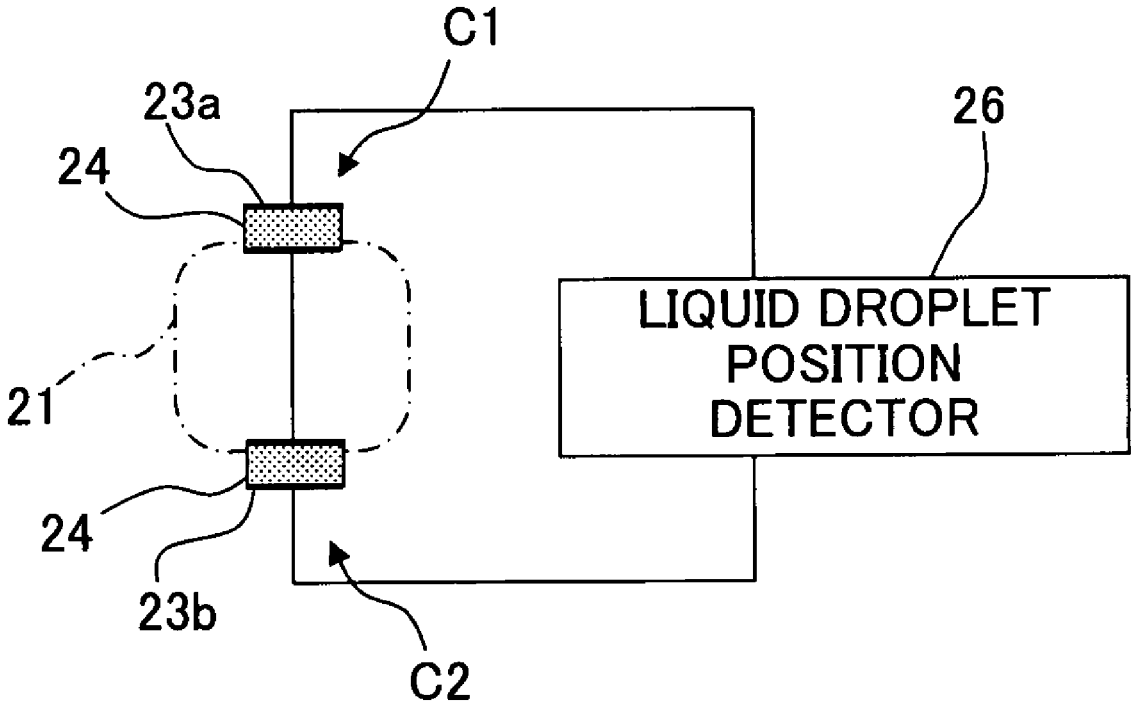
FIG. 5 is a diagram showing schematically a circuit formed by a second electrode, an insulating layer, and a liquid droplet, in a state in which a liquid droplet exists in an area in which the second electrode is arranged.

Incidentally, the two split electrodes 23*a* and 23*b* of the second electrode 23 are connected to a liquid droplet position detector 26 which detects an electrostatic capacitance between the two split electrodes 23*a* and 23*b*. As shown in FIG. 3A, the two split electrodes 23*a* and 23*b* are arranged symmetrically with respect to the straight line L passing through the center of gravity of the first electrode 22 and the center of gravity of the second electrode 23. In this case, when the liquid droplet 21 is transported from the area at which the first electrode 22 is arranged to the area at which the second electrode 23 is arranged, the liquid droplet 21 is positioned such that the liquid droplet 21 is spread over the two split electrodes 23*a* and 23*b*. In other words, the liquid droplet 21 is positioned between the two split electrodes 23*a* and 23*b* while making a contact with the two split electrodes 23*a* and 23*b* (refer to FIG. 9A and FIG. 9B). At this time, a condenser is formed by the split electrodes 23*a* and 23*b*, the electroconductive liquid droplet 21, and the insulating layer 24 (dielectric substance) sandwiched between the liquid droplet 21 and the split electrodes 23*a* and 23*b*. In other words, it is possible to indicate a system formed by the two split electrodes 23*a* and 23*b*, the insulating layer 24, and the liquid droplet 21 as a circuit which is formed by two condensers C1 and C2 connected in series as shown in FIG. 5.

In other words, when the liquid droplet 21 exists on the area at which the second electrode 23 is arranged, an electrostatic capacitance (for example about 40 nF when a thickness of the insulating layer 24 made of a fluororesin is 0.5 μm) of the condensers C1 and C2 between the two split electrodes 23*a* and 23*b* is detected by the liquid droplet position detector 26. On the other hand, when the liquid droplet 21 is not on the area at which the second electrode 23 is arranged (when positioned on the area at which the first electrode 22 is arranged), as compared to a case in which the liquid droplet 21 is positioned on the area at which the second electrode 23 is arranged, the electrostatic capacitance detected by the liquid droplet position detector 26 is decreased (becomes low) or becomes zero depending on a distance between the two split electrodes 23*a* and 23*b*.

Consequently, in this embodiment, the liquid droplet position detector 26 is structured to be capable of detecting whether the liquid droplet 21 exists on the area at which the first electrode 22 is arranged or on the area at which the second electrode 23 is arranged, based on the electrostatic capacitance detected between the two split electrodes 23*a* and 23*b*. More concretely, when a detected value of the electrostatic capacitance is not less than a predetermined value, the liquid droplet position detector 26 makes a judgment that the liquid droplet 21 exists on the area at which the second electrode 23 is arranged, and that the atmosphere-communication hole 19 is open. On the other hand, when the detected value of the electrostatic capacitance is less than the predetermined value (for example, a value close to 0), the liquid droplet position detector 26 makes a judgment that the liquid droplet 21 does not exist on the area at which the second electrode 23 is arranged (exists on the area at which the first electrode 22 is arranged), and that the atmosphere-communication hole 19 is closed. In other words, the two split electrodes function as sensors which cooperate to sense the presence of the liquid droplet.

Next, a liquid droplet transporting operation of the liquid droplet transporting section 20 will be described by referring to FIG. 6A to FIG. 10B. In FIG. 6A to FIG. 10B, "+" indicates that a predetermined electric potential is applied to the electrode, and "GND" indicates that the ground electric potential is applied to the electrode.

Figure 6A:
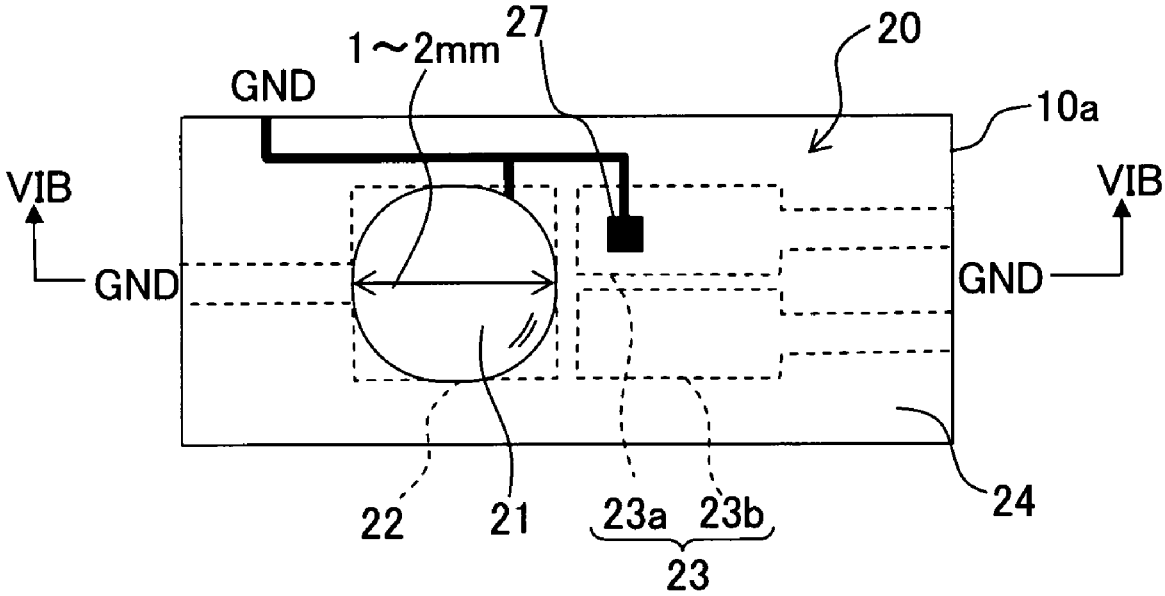
FIG. 6A is a diagram showing a plan view of the liquid droplet transporting section in the state in which a liquid droplet exists in an area in which a first electrode is arranged.
Figure 6B:
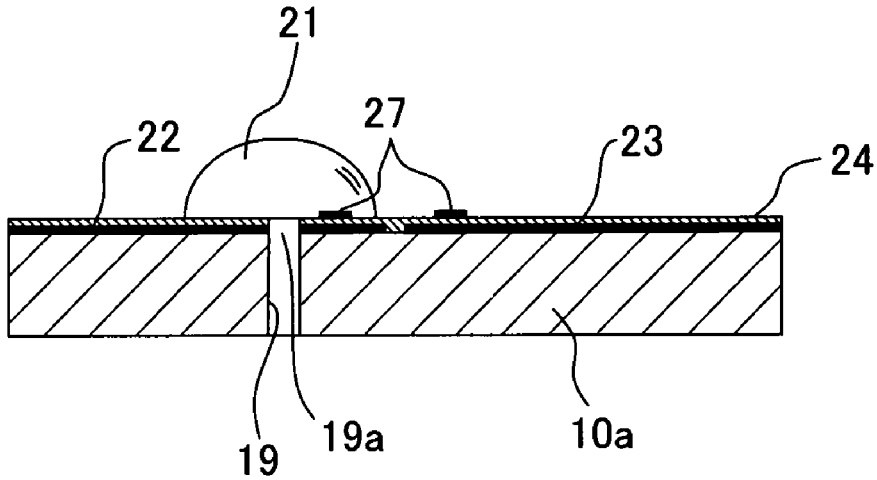
FIG. 6B is a cross-sectional view taken along a line VIB-VIB in FIG. 6A.

As shown in FIG. 6A and FIG. 6B, in a state in which the liquid droplet 21 exists on the area at which the first electrode 22 is arranged, the atmosphere-communication hole 19 is closed by the liquid droplet 21. Moreover, the ground electric potential is applied to each of the first electrode 22 and the second electrode 23 (two split electrodes 23*a* and 23*b*), and the liquid droplet 21 with a wide wetting angle, is accommodated in the area at which the first electrode 22 is arranged. The liquid droplet 21 is in contact with the ground electrode 27, and is kept at the ground electric potential. A diameter of the liquid droplet 21 may be such that the liquid droplet 21 is not protruding out from the first electrode 22 and the second electrode 23, and in this embodiment the diameter of the liquid droplet 21 is approximately 1 mm to 2 mm.

Figure 7A:
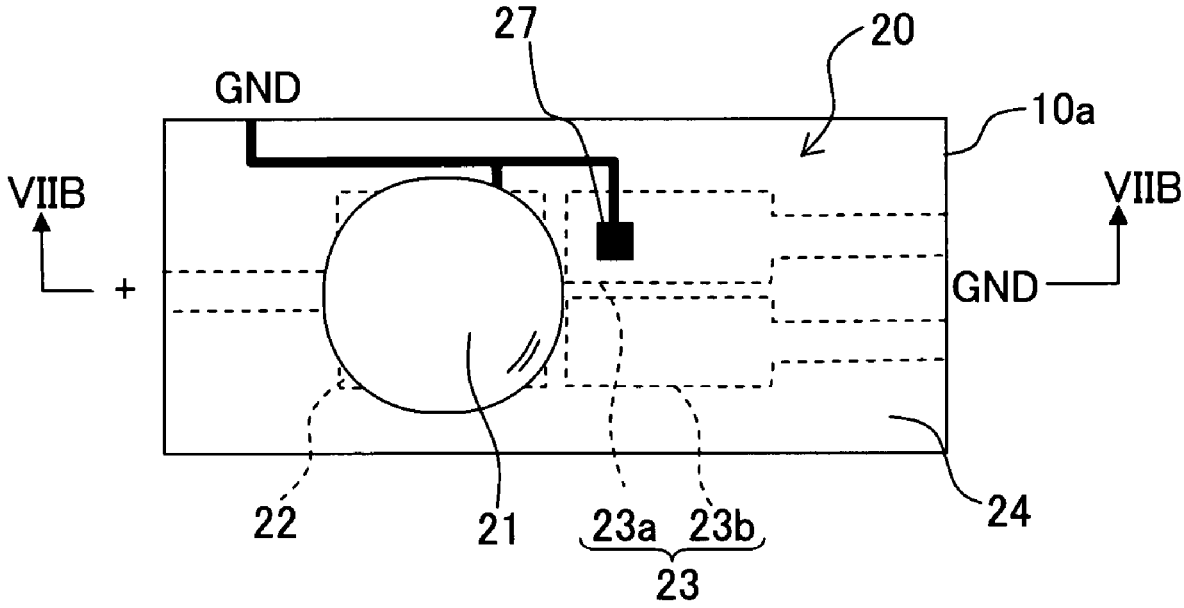
FIG. 7A is a plan view showing the liquid droplet transporting section immediately before transporting the liquid droplet to the second electrode.
Figure 7B:
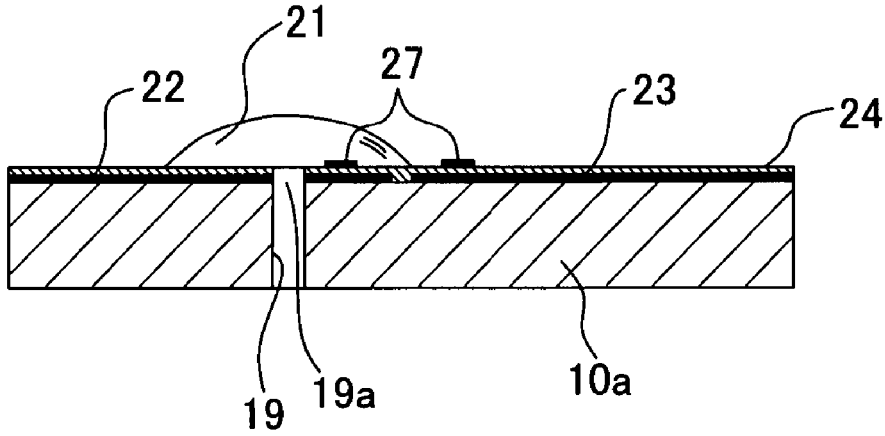
FIG. 7B is a cross-sectional view taken along a line VIIB-VIIB in FIG. 7A.

From a state in FIG. 6A and FIG. 6B, in a case of transporting the liquid droplet 21 to the area at which the second electrode 23 is arranged, firstly, as shown in FIG. 7A and FIG. 7B, a predetermined electric potential is applied to the first electrode 22 by the electric potential applying section 25. As a result, since an electric potential difference is generated between the first electrode 22 to which the predetermined electric potential is applied and the liquid droplet 21 which is kept at the ground electric potential, the liquid repellent property (wetting angle of the liquid droplet 21) of the insulating layer 24 in the area at which the first electrode 22 is arranged, is declined, and the liquid droplet 21 is spread wetting up to an area between the area at which the first electrode 22 is arranged and the area at which the second electrode 23 is arranged.

Figure 8A:
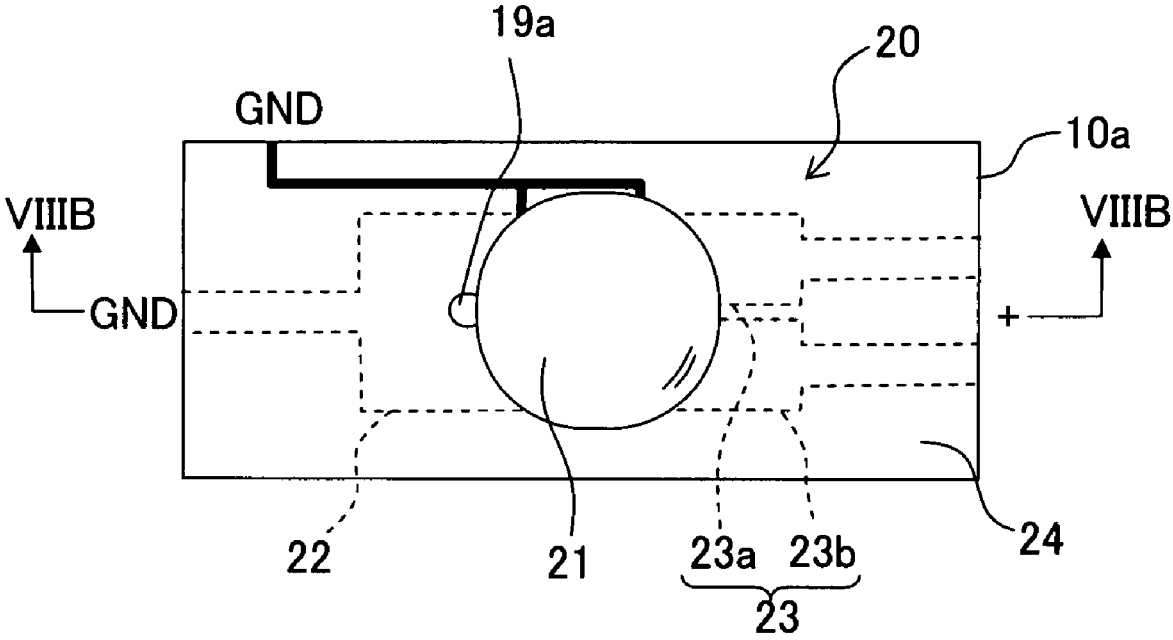
FIG. 8A is a plan view showing the liquid droplet transporting section during transporting the liquid droplet to the second electrode.
Figure 8B:
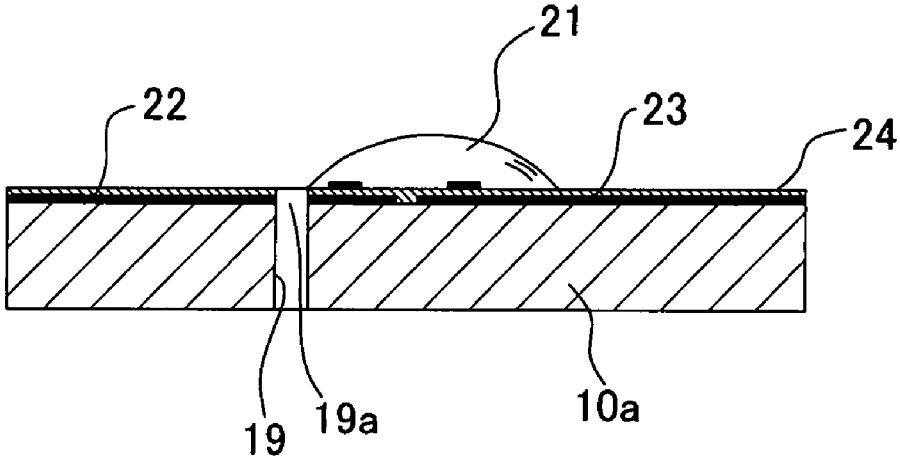
FIG. 8B is a cross-sectional view taken along a line VIIIB-VIIB in FIG. 8A.
Figure 9A:
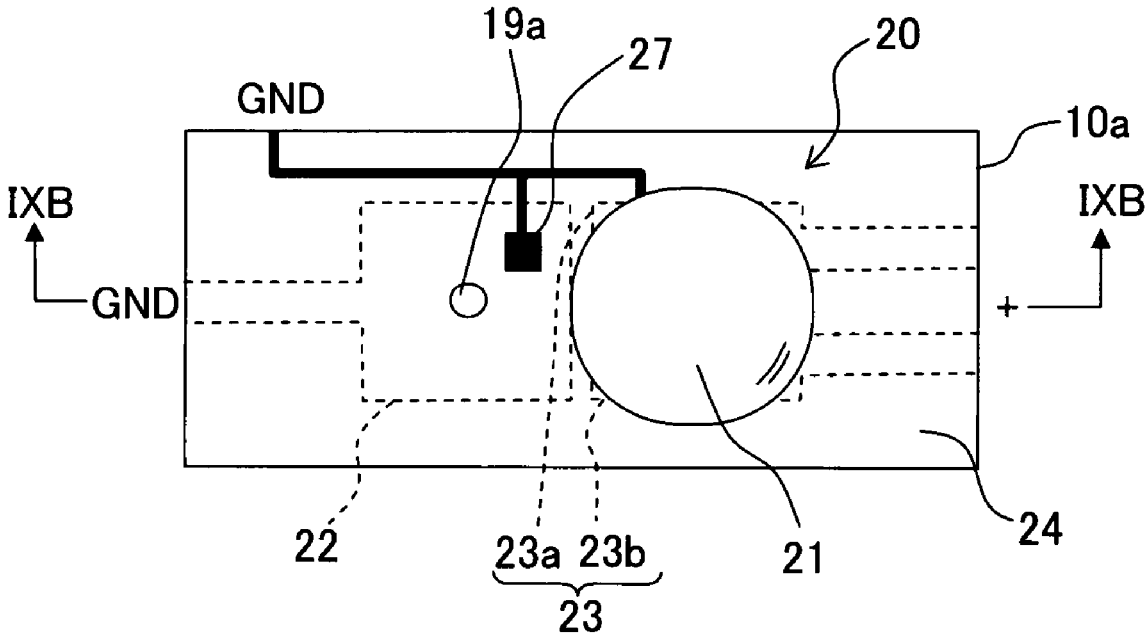
FIG. 9A is a plan view showing the liquid droplet transporting section immediately after transporting the liquid droplet to the second electrode.
Figure 9B:
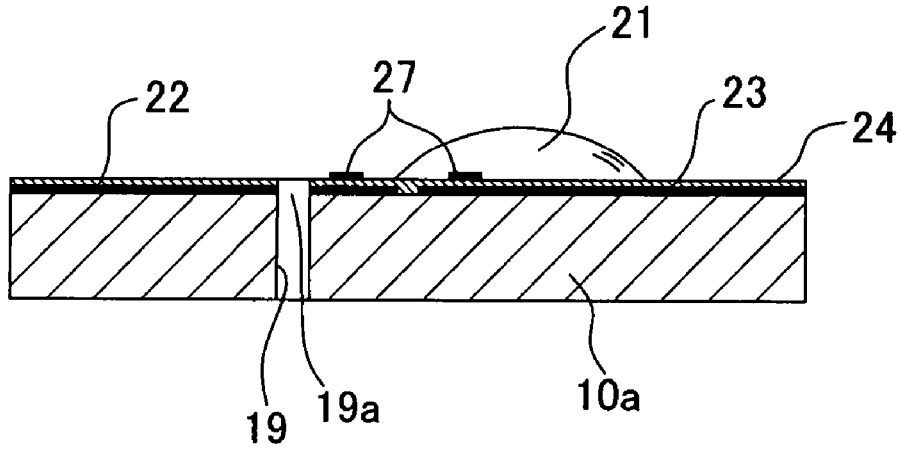
FIG. 9B is a cross-sectional view taken along a line IXB-IXB in FIG. 9A.

Next, as shown in FIG. 8A and FIG. 8B, the electric potential applying section 25 switches the electric potential of the first electrode 22 from the predetermined electric potential to the ground electric potential, and at the same time switches the electric potential of the second electrode 23 from the ground electric potential to the predetermined electric potential. As a result, the liquid repellent property of the insulating layer 24 in the area at which the first electrode 22 is arranged is improved and the liquid repellent property of the insulating layer in the area at which the second electrode 23 is arranged is declined. Therefore, the liquid droplet 21 which has been spread wetting up to the area between the area at which the first electrode 22 is arranged and the area at which the second electrode 23 is arranged, moves toward the second electrode 23 having the lower liquid repellent property, and as shown in FIG. 9A and FIG. 9B, the atmosphere-communication hole 19 is opened.

Figure 10A:
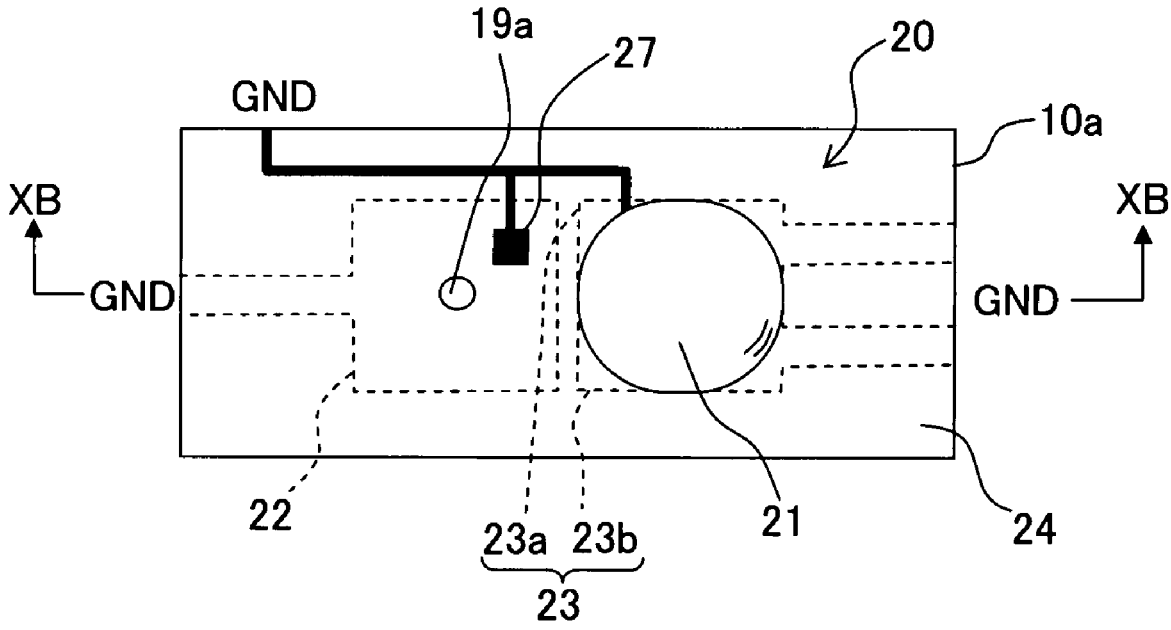
FIG. 10A is a plan view showing the liquid droplet transporting section in the state in which the liquid droplet exists in the area in which the second electrode is arranged.
Figure 10B:
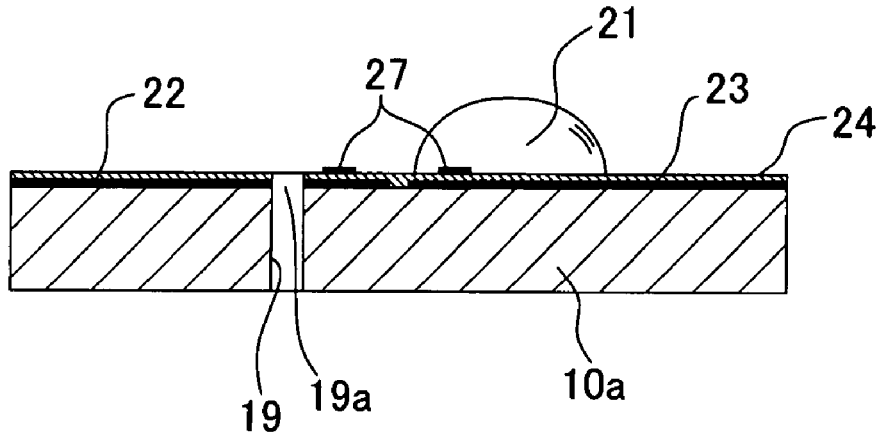
FIG. 10B is a cross-sectional view taken along a line XB-XB in FIG. 10A.

Further, when the liquid droplet 21 is moved completely to the area at which the second electrode 23 is arranged, as shown in FIG. 10A and FIG. 10B, the electric potential of the second electrode 23 is switched from the predetermined electric potential to the ground electric potential by the electric potential applying section 25. As a result, the liquid repellent property of the area at which the second electrode 23 is arranged is improved, the wetting angle of the liquid droplet 21 becomes wide (is increased), and the liquid droplet 21 is accommodated in the area at which the second electrode 23 is arranged.

Conversely, as shown in FIG. 10A and FIG. 10B, with the liquid droplet 21 existing on the area at which the second electrode 23 is arranged, and the atmosphere-communication hole 19 open, when the predetermined electric potential is applied to the first electrode 22 and at the same time, the ground electric potential is applied to the second electrode 23 by the electric potential applying section 25, the liquid droplet 21 moves from the area at which the second electrode 23 is arranged to the area at which the first electrode 22 is arranged, and as shown in FIG. 6A and FIG. 6B, the atmosphere-communication hole 19 is closed by the liquid droplet 21.

Figure 4:
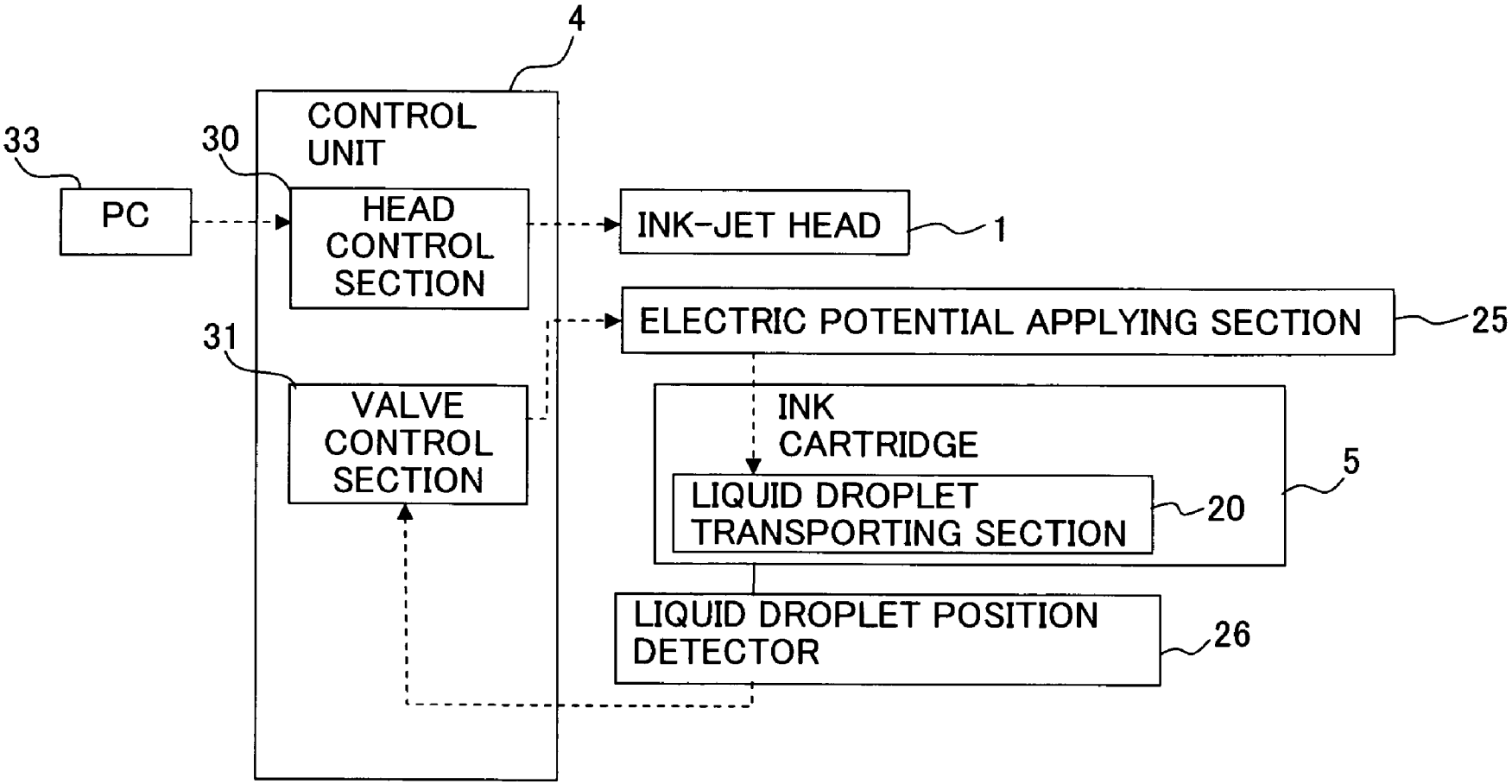
FIG. 4 is a block diagram showing an electrical structure of the ink-jet printer according to the first embodiment.

Next, an electrical structure of the ink-jet printer 100 by referring mainly to the control unit 4 will be described by referring to a block diagram in FIG. 4. The control unit 4 includes a CPU which is a central processing unit, a ROM (Read Only Memory) in which computer programs and data for controlling each section of the ink-jet printer are stored, a RAM (Random Access Memory) which stores temporarily data processed by the CPU, and the like. Moreover, as shown in FIG. 4, the control unit 4 includes a head control section 30 which controls an ink jetting operation of the ink-jet head 1, and a valve control section 31 which controls an opening and closing operation of the valve 11.

The head control section 30 controls the ink-jet head 1, based on a printing data which is input from a PC 33 and makes the ink-jet head 1 to jet the ink onto the recording paper P, and makes the ink-jet head 1 to record predetermined characters and image on the recording paper P.

Moreover, the valve control section 31 controls the valve 11 to open and close the atmosphere-communication hole 19. The atmosphere-communication hole 19 is opened only when the ink jetting operation of the ink-jet head 1 is performed, and is closed when the ink jetting operation is not performed.

Figure 11:
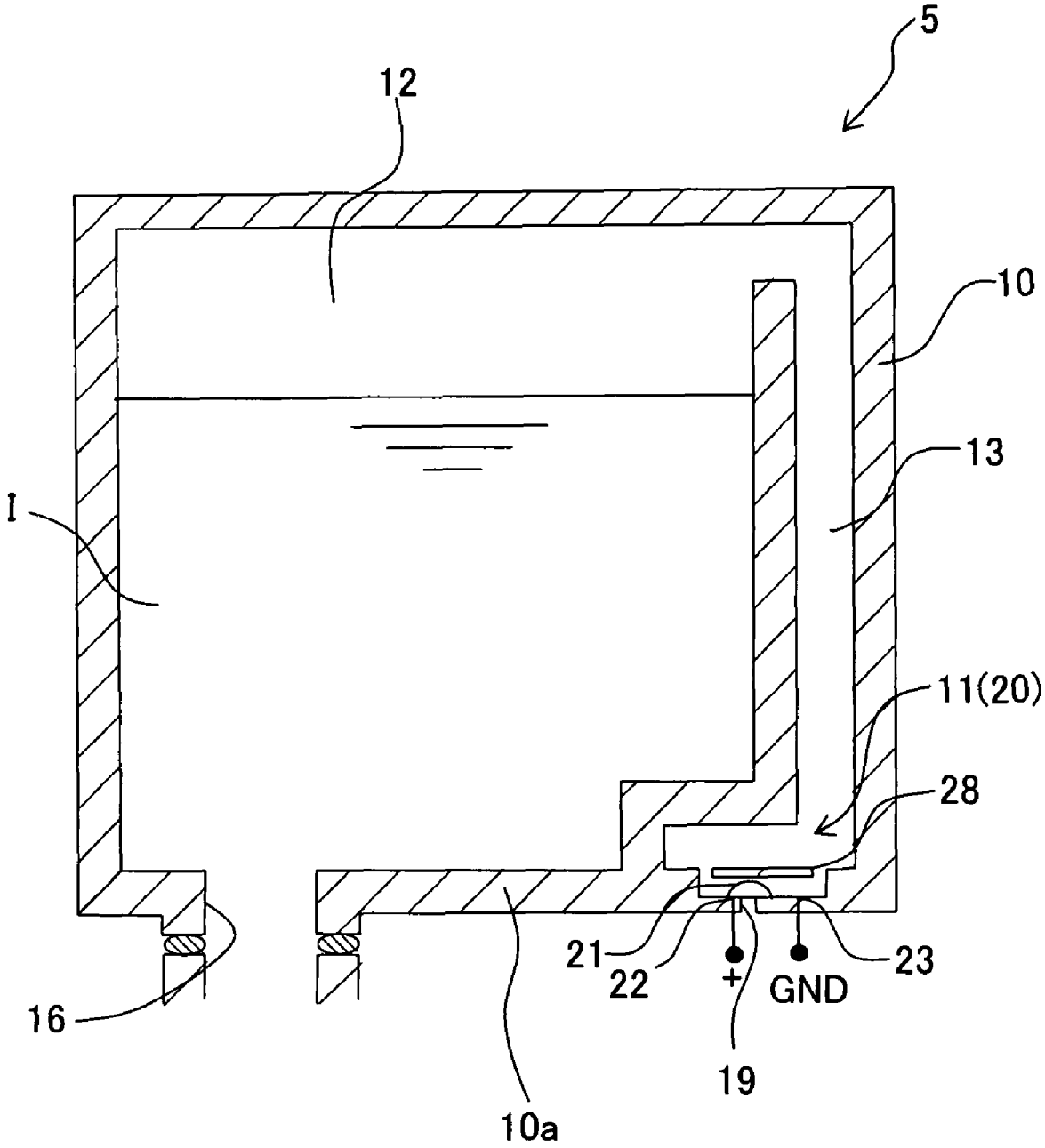
FIG. 11 is a vertical cross-sectional view of an ink cartridge when an atmosphere-communication hole is closed.
Figure 12:
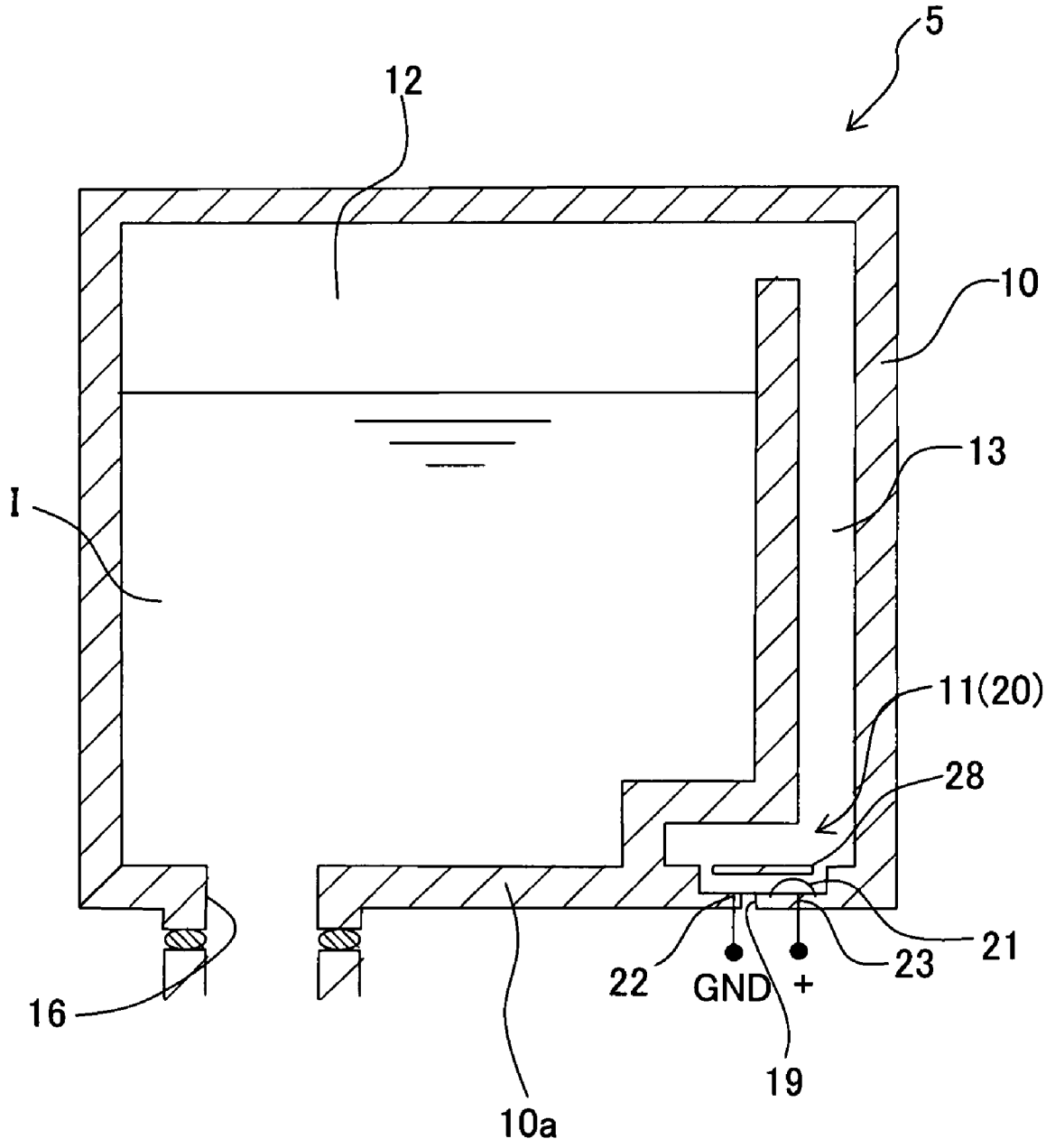
FIG. 12 is a vertical cross-sectional of the ink cartridge when the atmosphere-communication hole is open.

To describe concretely, as shown in FIG. 11, with the atmosphere-communication hole 19 closed, when a print command is input from the PC 33, the valve control section 31, before the ink-jetting operation of the ink-jet head 1 is performed, outputs to the electric potential applying section 25 a signal to open the atmosphere-communication hole 19. At this time, the electric potential applying section 25 applies the ground electric potential to the first electrode 22, and the predetermined electric potential to the second electrode 23. As a result, as shown in FIG. 12, the liquid droplet 21 is transported from the first electrode 22 to the second electrode 23, and the atmosphere-communication hole 19 is opened.

Moreover, when the recording on the recording paper P is completed, the valve control section 31 outputs to the electric potential applying section 25 a signal to close the atmosphere-communication hole 19. At this time, the electric potential applying section 25 applies the predetermined electric potential to the first electrodes 22 and the ground electric potential to the second electrode 23. As a result, as shown in FIG. 11, the liquid droplet 21 is transported from the second electrode 23 to the first electrode 22, and the atmosphere-communication hole 19 is closed by the liquid droplet 21. In this manner, the valve 11 opens the atmosphere-communication hole 19 only when the ink is jetted from the ink-jet head 1. Therefore, there is no shortage of supply of the ink I to the ink-jet head 1, and it is possible to prevent effectively the drying (thickening) of the ink.

Moreover, as it has been described above, the electrostatic capacitance between the two split electrodes 23*a* and 23*b* is detected by the liquid droplet position detector 26, and the position of the liquid droplet (in other words, the open or closed state of the atmosphere-communication hole 19) is detected based on the electrostatic capacitance which is detected. Further, this detection result is output to the valve control section 31.

Consequently, the valve control section 31 is capable of monitoring the open and closed state of the atmosphere-communication hole, according to the detection result detected by the liquid droplet position detector 26. The valve control section 31, based on the observation result, is capable of controlling the valve 11 not only at the time of a recording operation described above, but also at the time of a purge operation. For example, when the ink cartridge 5 is removed from the ink-jet printer 100 and installed again, a detector which detects installing and removing of the ink cartridge detects a time for which the ink cartridge 5 was removed from the ink-jet printer 100. Furthermore, when the time for which the ink cartridge 5 was removed is more than a predetermined value, a judgment is made that drying of the ink in the ink cartridge 5 is progressing, and the purge operation is carried out. At this time, when a detection result that the atmosphere-communication hole 19 is closed is output by the liquid droplet position detector 26, it is necessary to open the atmosphere-communication hole 19 for performing the purge. Therefore, the valve control section 31 outputs to the electric potential applying section 25, a signal for opening the atmosphere-communication hole 19. On the other hand, when a detection result that the atmosphere-communication hole 19 is closed is output, the purge may be carried out with the atmosphere-communication hole 19 in an open state as it has been. Therefore, the valve control section 31 does not output a signal to the electric potential applying section 25, and the atmosphere-communication hole 19 is kept to be in the open state as it has been till the purge is carried out. Moreover, when the time for which the ink cartridge 5 was removed is not more than the predetermined value, it is not necessary to carry out the purge operation. Consequently, when a detection result that the atmosphere-communication hole 19 is open is output by the liquid droplet position detector 26, the valve control section 31 outputs a signal to close the atmosphere-communication hole 19 to the electric potential applying section 25. On the other hand, when a detection result that the atmosphere-communication hole 19 is closed is output, the valve control section 31 does not output a signal to the electric potential applying section 25, and the atmosphere-communication hole 19 is kept to be in a closed state till the subsequent recording operation or the purge operation.

According to the first embodiment described above, the following effect is achieved. By applying different electric potential to the first electrode 22 and the second electrode 23 to differ the liquid repellent property (wetting angle) on the surface of the insulating layer 24 covering the first electrode 22 and the second electrode 23, it is possible to transport the liquid droplet 21 from an area having a higher liquid repellent property to an area having a lower liquid repellent property, between the area at which the first electrode 22 is arranged and the area at which the second electrode 23 is arranged. In other words, by (using) the liquid droplet transporting section 20 having a simple structure formed by the two electrodes 22 and 23 (the first electrode 22 and the second electrode 23), and the insulating layer 24, it is possible to open and close the atmosphere-communication hole 19. Moreover, since the ground electrode 27 which is kept at the ground electric potential is arranged in each of the area at which the first electrode 22 is arranged and the area at which the second electrode 23 is arranged, the electric potential of the liquid droplet 21 is kept all the time at the ground electric potential. Consequently, since the electric potential difference between the first electrode 22, the second electrode 23, and the liquid droplet 21 is stable, it is possible to perform assuredly the operation of transporting the liquid droplet 21.

Furthermore, since the second electrode 23 is divided into two split electrodes 23*a* and 23*b* arranged to be isolated mutually, it is possible to detect whether the liquid droplet 21 exists on the area at which the first electrode 22 is arranged or on the area at which the second electrode 23 is arranged, based on the electrostatic capacitance between the two split electrodes 23*a* and 23*b*.

Moreover, by applying the present invention to the valve 11 which opens and closes the atmosphere-communication hole 19 of the ink cartridge 5, it is possible to close the atmosphere-communication hole 19 by transporting the liquid droplet 21 to the first electrode 22 when the ink is not supplied from the ink cartridge 5 to the ink-jet head 1. On the other hand, it is possible to open the atmosphere-communication hole 19 by transporting the liquid droplet 21 to the second electrode 23 when the ink is not supplied. In other words, by using the valve 11 or the liquid droplet transporting apparatus 20 having a simple structure, it is possible to prevent effectively the drying (thickening) of the ink without causing an insufficiency of the ink supply.

Next, modifications in which various modifications are made in the first embodiment described above, will be described below. Same reference numerals are assigned to components having basically the same structure as in the first embodiment, and description of such components is omitted.

First Modification

Figure 3E:
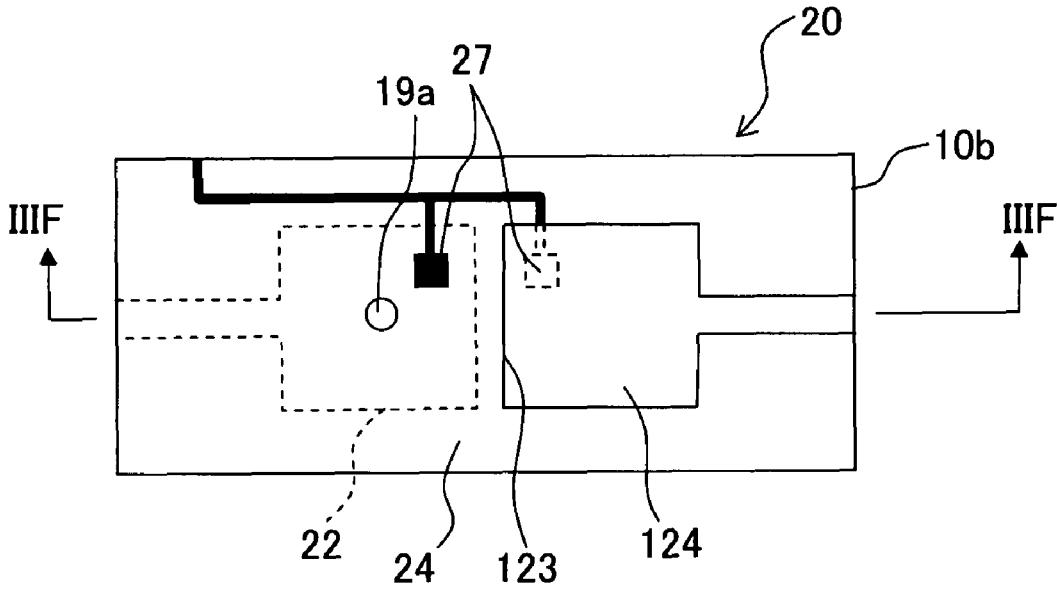
FIG. 3E is a plan view corresponding to FIG. 3A, of a liquid droplet transporting apparatus according to a first modification of the first embodiment.
Figure 3F:
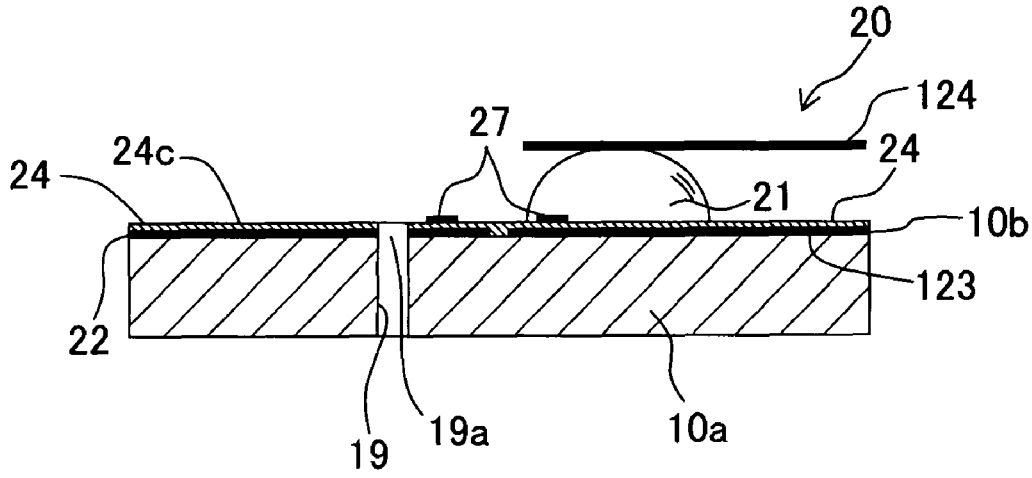
FIG. 3F is a cross-sectional view taken along a line IIIF-IIIF in FIG. 3E.

In the first embodiment, the second electrode 23 was divided into two split electrodes 23*a* and 23*b*, and arranged with the first electrode 22, on the upper surface 10*b* of the bottom wall 10*a* of the cartridge body 10. However, as shown in FIGS. 3E and 3F, a single second electrode 123 may be arranged with the first electrode 22, on the upper surface 10*b* of the bottom wall 10*a* of the cartridge body 10, and a third electrode 124 different from the second electrode 123 may be arranged in parallel to the upper surface 10*b* of the bottom wall 10*a*, isolated from the second electrode 123. In this case, each of the one of the split electrodes 23*a*, and the other split electrode 23*b* in the first embodiment corresponds to the second electrode 123 and the third electrode 124 in the first modification. FIG. 3E and FIG. 3F are diagrams showing an arrangement relation of the second electrode 123 and the third electrode 124. FIG. 3E is a top view of the liquid droplet transporting apparatus 20, and FIG. 3F is a cross-sectional view taken along a line IIIF-IIIF in FIG. 3E.

In the liquid droplet transporting apparatus 20 of the first modification, the atmosphere-communication hole 19 is formed in the bottom wall 10*a* of the cartridge body 10 similarly as in the first embodiment. The first electrode 22 is arranged on the upper surface 10*b* of the bottom wall 10*a*. Moreover, the single second electrode 123 having a rectangular shape is arranged apart from the first electrode 22 on the upper surface 10*b* of the bottom wall 10*a*. The insulating layer 24 is formed such that both the first electrode 22 and the second electrode 123 are completely covered. Two ground electrodes 27 are arranged on a portion of the insulating layer 24 covering the first electrode 22 and the second electrode 123. Furthermore, a third electrode 124 is arranged in parallel to the upper surface 10*b* of the bottom wall 10*a* to face the second electrode 123. In other words, when the liquid droplet transporting apparatus 20 is viewed from a top (upper side of a paper surface in FIG. 3E), the third electrode 124 is arranged to cover the second electrode 123. (in FIG. 3E, the second electrode 123 completely overlaps the third electrode 124). The third electrode 124 and the second electrode 123 have the same rectangular flat shape. Each of the third electrode 124 and the second electrode 123 is connected to the liquid droplet position detector 26 shown in FIG. 4. The liquid droplet position detector 26 detects an electrostatic capacitance between the second electrode 123 and the third electrode 124.

According to the principle described in the first embodiment, when the liquid droplet 21 is transported from the first electrode 22 to the second electrode 123, the liquid droplet 21 exists between the second electrode 123 and the third electrode 124 facing the second electrode 123, and is in contact with both the second electrode 123 and the third electrode 124. At this time, a condenser is formed by the second electrode 123, the third electrode 124, the electroconductive liquid droplet 21, and the insulating layer 24. Consequently, when the liquid droplet 21 exists on the second electrode 123, a predetermined electrostatic capacitance is detected between the second electrode 123 and the third electrode 124, by the liquid droplet position detector 26. On the other hand, when the liquid droplet 21 is not on the second electrode 123, either the electrostatic capacitance is not detected by the liquid droplet position detector 26, or the detected value of the electrostatic capacitance is substantially lower than the predetermined value. In other words, according to the first modification, by measuring the electrostatic capacitance, it is possible to detect whether or not the liquid droplet 21 exists on the second electrode 123. Moreover, when the liquid droplet transporting apparatus 20 is viewed from the top, since the third electrode 124 is arranged to cover the second electrode 123, when the liquid droplet 21 is on the second electrode 123, even if the liquid droplet 21 is positioned away from a center of the second electrode 123 (even if a center of the liquid droplet 21 does not coincide with a center of the second electrode 123), the third electrode 124 can make a contact with the liquid droplet 21. Consequently, even when the liquid droplet 21 exists at a position shifted away from the center of the second electrode 123, it is possible to detect assuredly the presence of the liquid droplet 21. The insulating layer 24 is formed on the first electrode 22 and the second electrode 123 similarly as in the first embodiment. Therefore, even when the insulating layer 24 is not formed on a surface of the third electrode 124, facing the second electrode 123, by applying different electric potential to the first electrode 22 and the second electrode 123, it is possible to transport the liquid droplet 21 between the area at which the first electrode 22 is arranged and an area at which the second electrode 123 is arranged.

In the first modification, a gap (distance) between the third electrode 124 and the insulating layer 24 may be such that the third electrode 124 can assuredly make a contact with the liquid droplet 21 when the liquid droplet exists on the second electrode 123. Moreover, the third electrode 124 has a rectangular flat shape similar to the shape of the second electrode 123 in the first modification. However, the flat shape of the third electrode 124 may be different from the flat shape of the second electrode 123, provided that the third electrode 124 assuredly makes a contact with the liquid droplet 21 when the liquid droplet 21 exists on the second electrode 123.

Second Modification

Figure 3G:
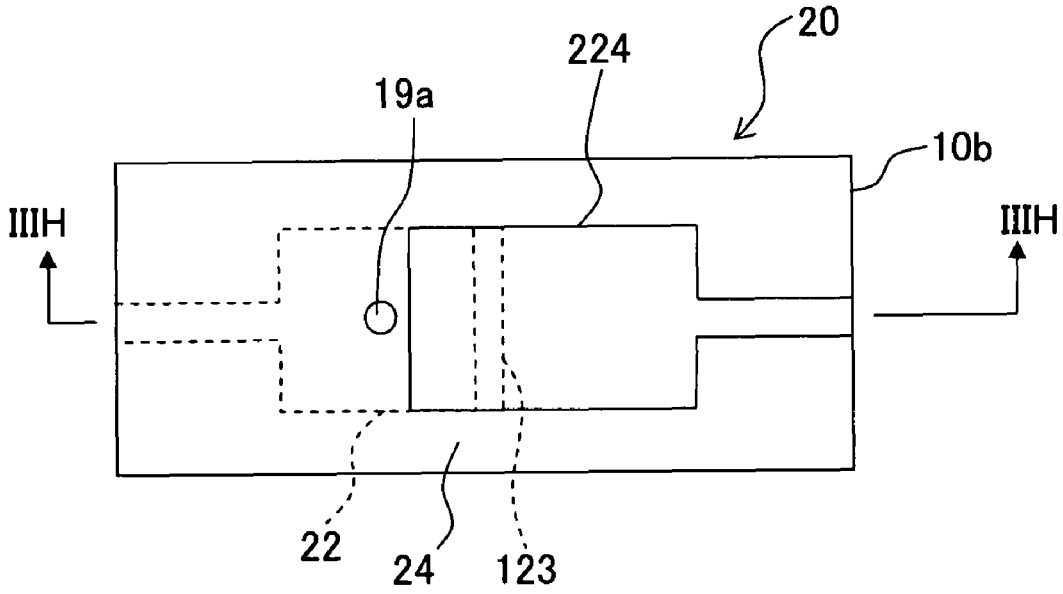
FIG. 3G is a plan view corresponding to FIG. 3A of a liquid droplet transporting apparatus according to a second modification of the first embodiment.
Figure 3H:
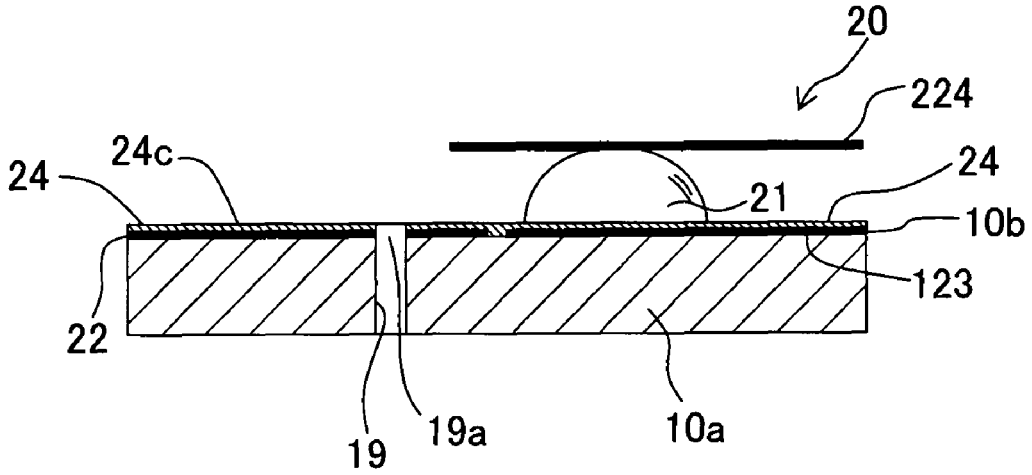
FIG. 3H is a cross-sectional view taken along a line IIIH-IIIH in FIG. 3G.

A second modification in which modifications are made in the first modification will be described below by referring to FIG. 3G and FIG. 3H. FIG. 3G and FIG. 3H are diagrams showing an arrangement relation of the second electrode 123 in the first modification, and a third electrode 224. FIG. 3G is a top view of the liquid droplet transporting apparatus 20, and FIG. 3H is a cross-sectional view taken along a line IIIH-IIIH in FIG. 3H. The second modification differs from the first modification at a point that the two ground electrodes 27 do not exist in the liquid droplet transporting apparatus 20. Moreover, when the liquid droplet transporting apparatus 20 is viewed from the top (upper side of the paper surface in FIG. 3G), it differs from the liquid droplet transporting apparatus 20 in the first modification at a point that the third electrode 224 extends up to the upper end opening 19*a* of the atmosphere-communication hole 19, in other words the third electrode 224 extends to cover a part of the second electrode 123. Furthermore, the third electrode 224 is always kept at the ground electric potential. Each of the third electrode 224 and the second electrode 123 is connected to the liquid droplet position detector 26 shown in FIG. 4. The liquid droplet position detector 26 detects an electrostatic capacitance between the second electrode 123 and the third electrode 224. Since the rest of the structure being similar to the structure in the first modification, the description thereof is omitted.

In the second modification, the third electrode 224 extends in parallel to the upper surface 10*b* of the bottom wall 10*a*, to face a part of the first electrode 22, and the second electrode 123. Therefore, the third electrode 224 makes a contact with the liquid droplet 21 even when the liquid droplet exists on the area at which the first electrode is arranged, and even when the liquid droplet exists on the area at which the second electrode 123 is arranged. Moreover, the third electrode 224 is always kept at the ground electric potential. Therefore, as in the first embodiment described above, the ground electrode 27 is not required to be provided separately. According to the principle described in the first embodiment, when the liquid droplet 21 is transported from the first electrode 22 to the second electrode 23, the liquid droplet 21 exists between the second electrode 123 and the third electrode 224 facing the second electrode 123, and makes a contact with both the second electrode 123 and the third electrode 224. As a result, a condenser made of the second electrode 123, the third electrode 224, the liquid droplet 21, and the insulating layer 24 is formed. Consequently, when the liquid droplet 21 exists on the second electrode 123, a predetermined electrostatic capacitance is detected by the liquid droplet position detector 26. On the other hand, when the liquid droplet 21 is not on the second electrode 123, either the electrostatic capacitance is not detected by the liquid droplet position detector 26, or an extremely small (low) electrostatic capacitance is detected by the liquid droplet position detector 26. According to the principle described above, even in the second modification, it is possible to detect whether or not the liquid droplet 21 exists on the second electrode 123, by using a liquid droplet transporting apparatus 20 having a simple structure. Furthermore, since the ground electrode is not required to be provided separately, the number of components is decreased, and it is possible to form the valve 11 and the liquid droplet transporting apparatus 20 having a simple structure. Consequently, it is possible to reduce a manufacturing cost.

Third Modification

In the first embodiment, the second electrode 23 is divided into two split electrodes 23*a* and 23*b*. However, instead of the second electrode 23, the first electrode 22 may be divided. Moreover, both the first electrode 22 and the second electrode 23 may be divided. Furthermore, it not particularly necessary that the first electrode 22 and the second electrode are divided into two, and may be divided into a plurality of split electrodes more than two. On the other hand, when it is not necessary to detect the position of the liquid droplet 21, it is not necessary that both the first electrode 22 and the second electrode 23 are divided. Moreover, when a fluctuation (change) in the electric potential of the liquid droplet 21 is sufficiently small with respect to the predetermined electric potential which is applied to the first electrode 22 and the second electrode 23, and there is almost no effect on the transporting of the liquid droplet 21, the ground electrode 27 which is for keeping the liquid droplet 21 at the ground electric potential, may be omitted.

Fourth Modification

Figure 13A:
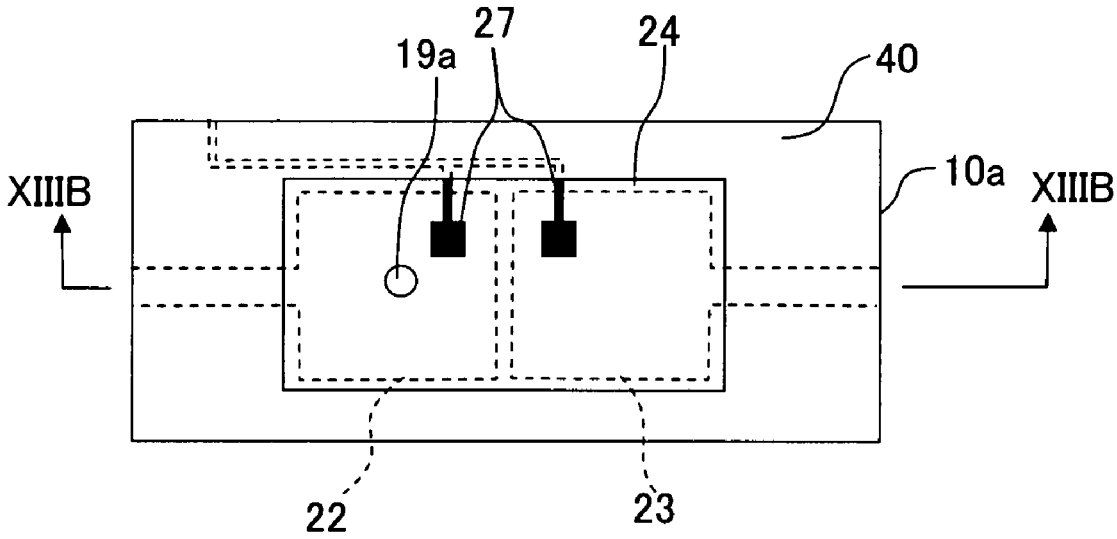
FIG. 13A is a plan view showing a liquid droplet transporting section in which a liquid repellent film is formed on outside the two electrodes, in a fourth modification of the first embodiment.
Figure 13B:
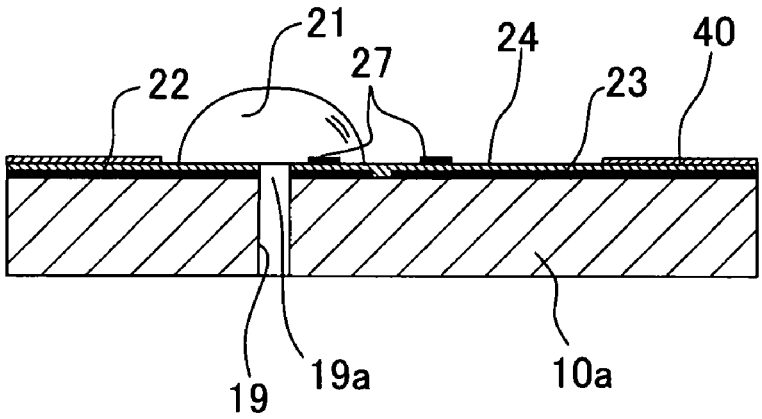
FIG. 13B is a cross-sectional view taken along a line XIIIB-XIIIB in FIG. 13A.

It is desirable that the liquid droplet transporting section 20 is capable of preventing the liquid droplet 21 from moving due to vibration of the liquid droplet 21 and the like, to an area outside the area at which the first electrode 22 is arranged and the area at which the second electrode 23 is arranged, or an area at which an electrode on an opposite side is arranged. For example, as shown in FIG. 13A and FIG. 13B, a liquid repellent film 40 (first liquid repellent film) having a liquid repellent property higher than the liquid repellent property of the insulating layer 24 all the time, may be formed on an area outside the area at which the first electrode 22 is arranged and the area at which the second electrode 23 is arranged, so as to surround both the areas at which the two electrodes (the first electrode 22 and the second electrode 23) are arranged. According to this structure, the movement of the liquid droplet 21 to the outside the area at which the electrode is arranged is prevented by the liquid repellent film 40. As shown in FIG. 13B, the liquid repellent film 40 may be formed to overlap the insulating layer 24, or the insulating layer 24 may not be formed on the area outside the area at which the first electrode 22 is arranged and the area at which the second electrode 23 is arranged, and the liquid repellent film 40 may be formed directly on the surface of the bottom wall 10*a* (substrate).

Figure 14A:
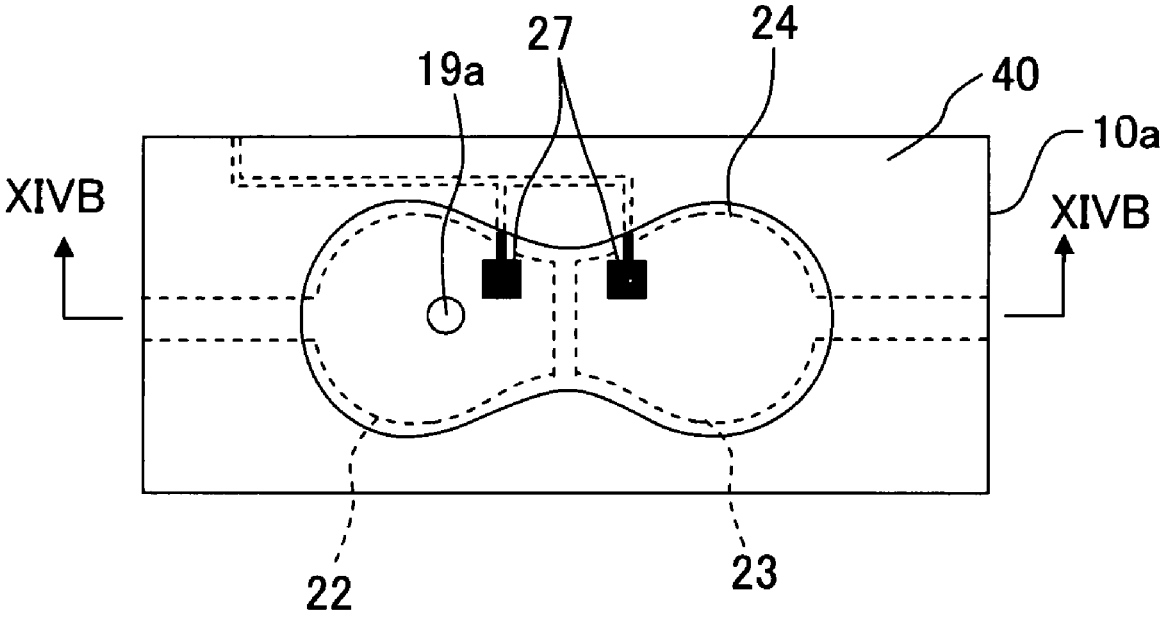
FIG. 14A is a plan view showing a liquid droplet transporting section in which a flat shape of the two electrodes is deformed, in the fourth modification of the first embodiment.
Figure 14B:
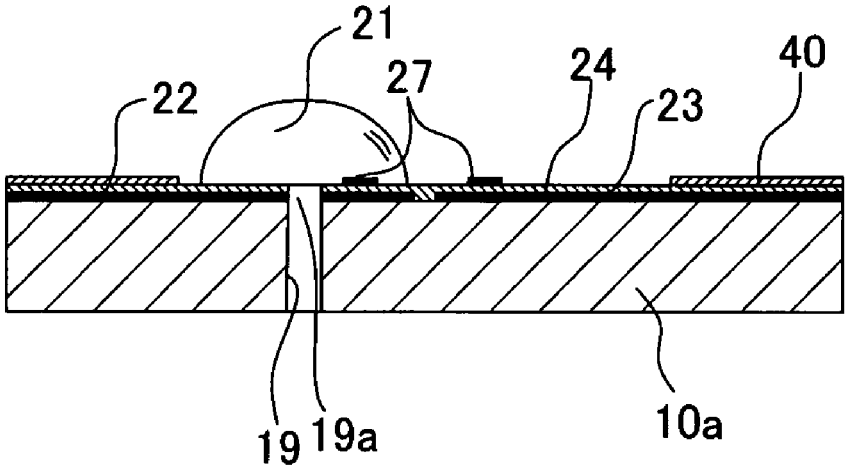
FIG. 14B is a cross-sectional view taken along a line XIVB-XIVB in FIG. 14A.

Moreover, as shown in FIG. 14A and FIG. 14B, a structure may be such that, a width of an end portion on a side where the first electrode 22 and the second electrode 23 are adjacent may be narrowed, and between the first electrode 22 and the second electrode 23, a width of an area in which the liquid repellent film 40 is not formed may be narrowed locally. In this structure, since the width of the area in which the liquid droplet 21 moves becomes narrow between the area at which the first electrode 22 is arranged and the area at which the second electrode 23 is arranged, the liquid droplet 21 hardly moves abruptly to the electrode on the opposite side, due to vibration, or the like.

Figure 15A:
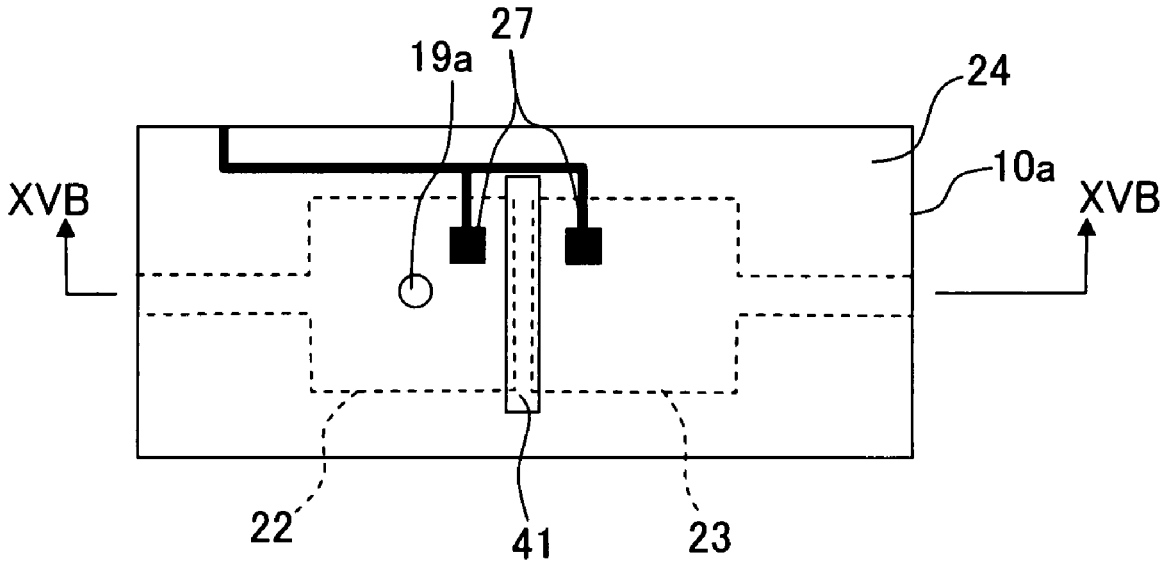
FIG. 15A is a plan view showing a liquid droplet transporting section in which the liquid repellent film is formed between the two electrodes, in the fourth modification of the first embodiment.
Figure 15B:
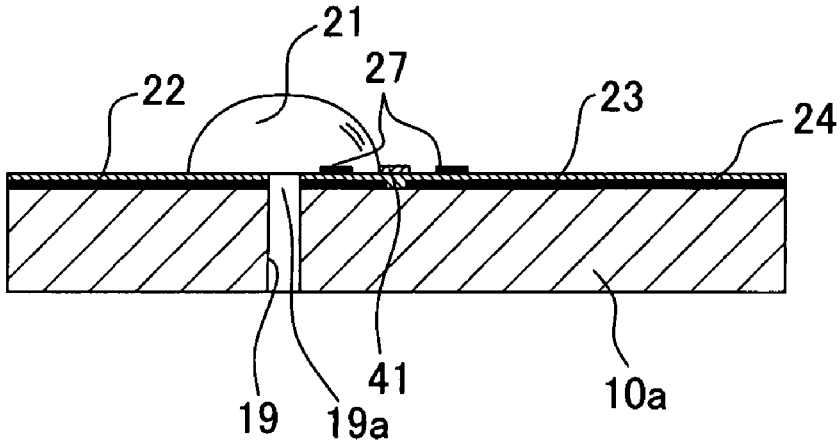
FIG. 15B is a cross-sectional view taken along a line XVB-XVB in FIG. 15A.

Or, as shown in FIG. 15A and FIG. 15B, a liquid repellent film 41 (second liquid repellent film) having a liquid repellent property higher than the liquid repellent property of the insulating layer 24 all the time, may be formed in the area between the area at which the first electrode 22 is arranged and the area at which the second electrode 23 is arranged. In this structure, the abrupt movement of the liquid droplet 21 due to vibration or the like to the electrode on the opposite side is prevented by the liquid repellent film 41. Moreover, the liquid repellent film 41, similarly as the liquid repellent film 40 described above (refer to FIGS. 13A and 13B, and FIGS. 14A and 14B), may be formed to overlap the insulating layer 24, or may be formed directly on the surface of the bottom wall 10*a*.

Figure 16A:
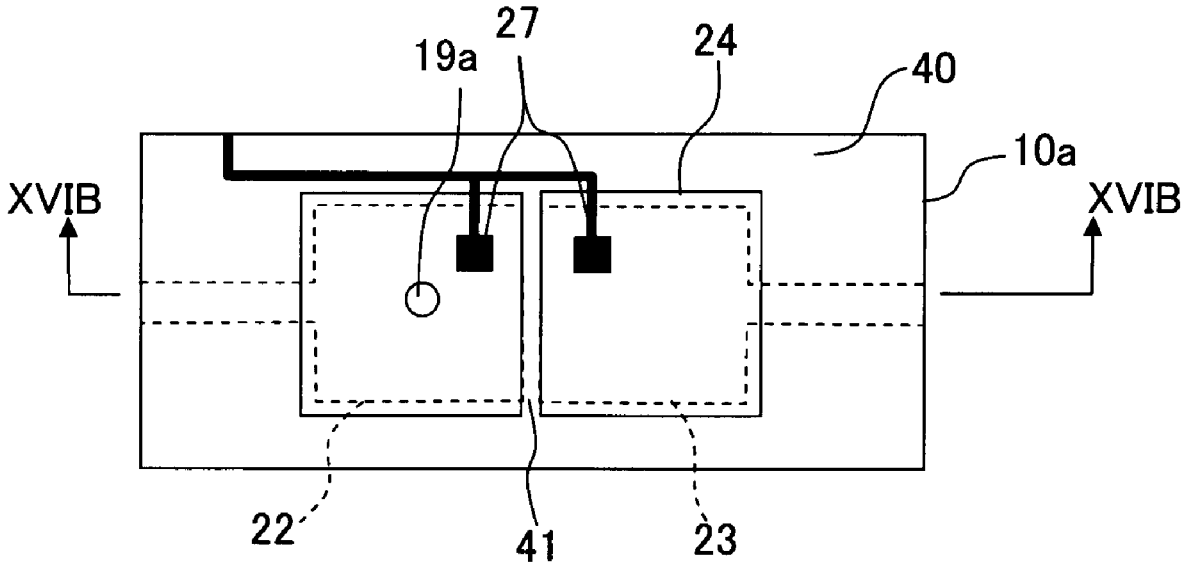
FIG. 16A is a plan view showing a liquid droplet transporting section in which the liquid repellent film is formed on outside the two electrodes, and between the two electrodes, in the fourth modification of the first embodiment.
Figure 16B:
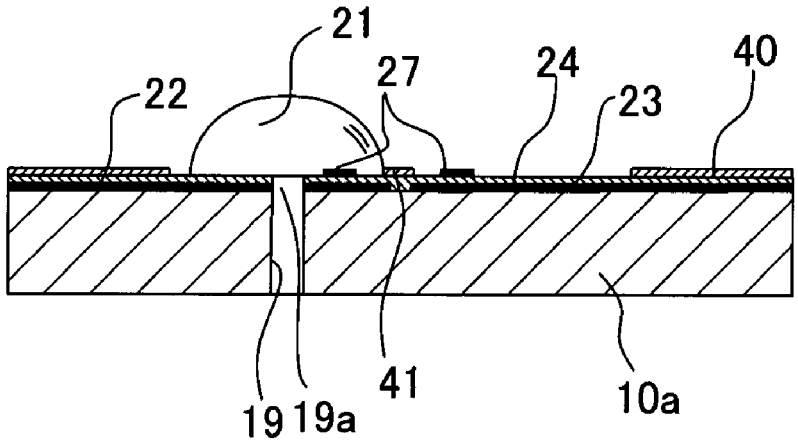
FIG. 16B is a cross-sectional view taken along a line XVIB-XVIB in FIG. 16A.

Furthermore, as shown in FIG. 16A and FIG. 16B, the liquid repellent film 40 may be formed on the upper surface of the insulating layer 24, on the outer side of the area at which the first electrode 22 is arranged and the area at which the second electrode 23 is arranged, and the liquid repellent film 41 may be arranged between the area at which the first electrode 22 is arranged and the area at which the second electrode 23 is arranged. According to this structure, both the movement of the liquid droplet 21 to the outside of the areas at which the electrodes (first electrode 22 and the second electrode 23) are arranged, and the movement of the liquid droplet 21 to the area on the opposite side at which the electrode is formed is prevented.

When a polyimide resin or an epoxy resin is used as the (for the) insulating layer 24, and on the other hand a fluororesin is used for the liquid repellent films 40 and 41, it is possible to make the liquid repellent property of the liquid repellent films 40 and 41 to be higher than the liquid repellent property of the insulating layer 24.

Moreover, if a wetting angle of the liquid droplet 21 on the surface of the insulating layer 24 is more than 90 degrees, a surface roughness of the liquid repellent films 40 and 41 may be more than a surface roughness of the insulating layer 24 since the liquid droplet 21 hardly moves abruptly even when there is vibration. On the other hand, when the wetting angle of the liquid droplet 21 on the surface of the insulating layer 24 is less than 90 degrees, since the liquid droplet 21 tends to move abruptly due to vibration, it is preferable that the surface roughness of the liquid repellent films 40 and 41 is less than the surface roughness of the insulating layer 24.

Figure 17A:
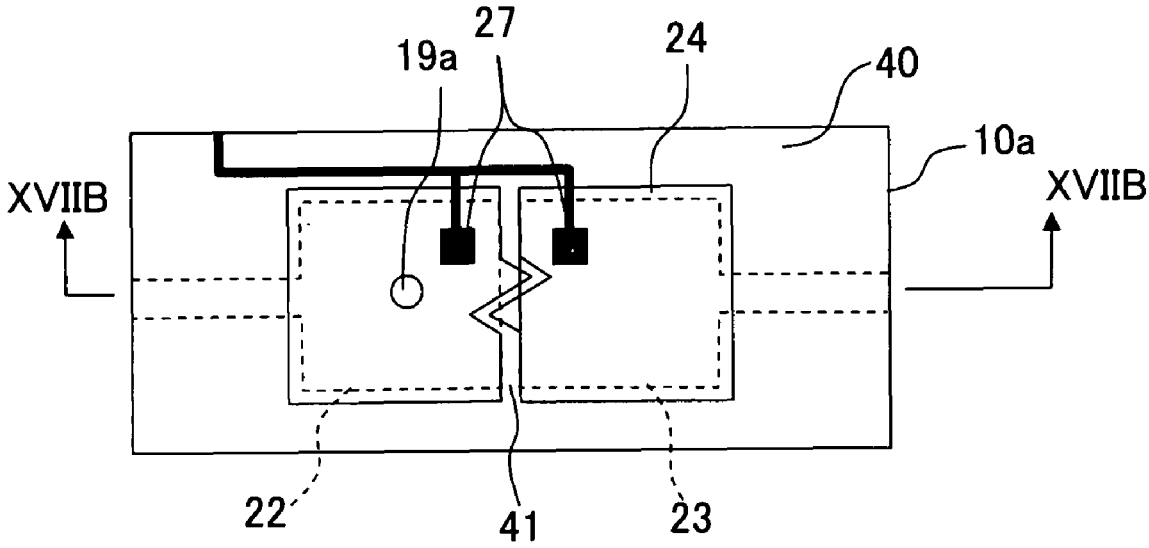
FIG. 17A is a plan view showing a liquid droplet transporting section in which a part of the liquid repellent film formed between the two electrodes is projected toward each of the electrode, in the fourth modification of the first embodiment.
Figure 17B:
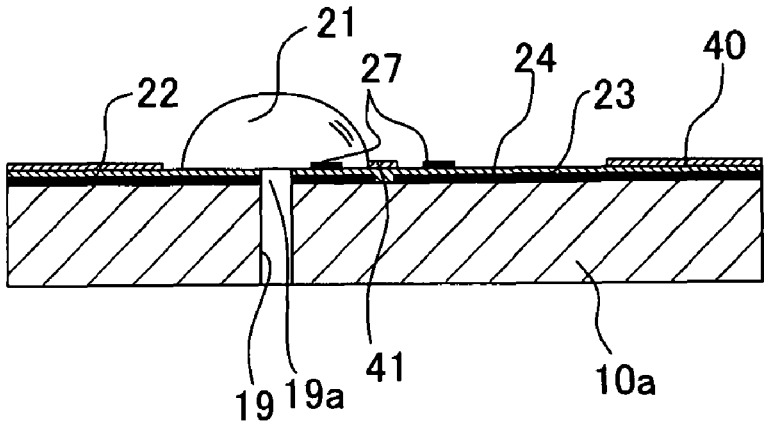
FIG. 17B is a cross-sectional view taken along a line XVIIB-XVIIB in FIG. 17A.

Moreover, when the liquid repellent film 41 is formed between the area at which the first electrode 22 is arranged and the area at which the second electrode 23 is arranged, the liquid repellent film 41 becomes a primary resistance for liquid droplet transporting between the first electrode 22 and the second electrode 23. Therefore, it is preferable to generate a transporting force which is capable of making the liquid droplet 21 cross over the liquid repellent film 41, by setting to be comparatively higher the electric potential of the electrode to which the liquid droplet is transported to decline sufficiently the liquid repellent property on the area at which that electrode is formed, Or, as shown in FIG. 17A and FIG. 17B, a part of the liquid repellent film 41 (second liquid repellent film) provided between the area at which the first electrode 22 is arranged and the area at which the second electrode 23 is arranged, may be projected toward each of the area at which the first electrode 22 is arranged and the area at which the second electrode 23 is arranged. According to this structure, the abrupt movement of the liquid droplet 21 to the electrode on the opposite side due to vibration or the like is prevented by the liquid repellent film 41, and when the liquid droplet 21 is transported between the areas at which the two electrodes (the first electrode 22 and the second electrode 23) are arranged, the liquid droplet 21 easily crosses over the liquid repellent film 41 from a portion projected toward areas in which the electrodes are arranged, and it is possible to move the liquid droplet 21 smoothly between the area at which the first electrode 22 is arranged and the area at which the second electrode 23 is arranged.

As it has been described above by referring to FIG. 13A to FIG. 17B, an embodiment in which the second electrode 23 is not divided is shown. However, it is needless to mention that even when the second electrode 23 is divided, the abovementioned structure is applicable.

Fifth Modification

The valve 11 may be structured such that the atmosphere-communication hole 19 is opened at regular intervals. When the printing is not performed for a long time, the atmosphere-communication hole 19 is not opened for a long time by the valve 11. Therefore, due to a temperature change and a pressure change in the atmosphere, there is a possibility of an excessive rise in a pressure, or generation of a negative pressure in the ink accommodating space 12 in the cartridge body 10. Therefore, when a structure is made such that when a judgment is made by the head control section 30 of the control unit 4 that a predetermined time has elapsed from a time at which the previous printing was completed, the valve control section 31 outputs to the electric potential applying section 25 a signal for opening the atmosphere-communication hole 19, the atmosphere-communication hole 19 is opened periodically (for a fixed interval), and an a difference in pressure inside and outside the cartridge body 10 is suppressed to be small.

Sixth Modification

In the first embodiment, the electric potential applying section 25 which applies the electric potential to the first electrode 22 and the second electrode 23, and the liquid droplet position detector 26 which detects the position of the liquid droplet 21 from the electrostatic capacitance between the two split electrodes 23*a* and 23*b*, are provided at the side of the ink-jet printer 100. However, the electric potential applying section 25 and the liquid droplet position detector 26 may be provided at the side of the ink cartridge 5, and may be connected to the control unit 4 (valve control section 31) on a side of the ink-jet printer 100. In other words, the valve 11 of the ink cartridge 5 may be provided with the liquid droplet transporting section 20 which includes the electric potential applying section 25 and the liquid droplet position detector 26.

Second Embodiment

Next, a second embodiment of the present invention will be described below. The second embodiment is an example in which the present invention is applied to a nozzle cap which is mounted on an ink jetting surface 1*a* of the ink-jet head 1. Same reference numerals are assigned to components having a structure similar as in the first embodiment, and the description of such components is omitted.

Similarly as in the first embodiment (refer to FIG. 1), the ink-jet head 1 jets the ink onto the recording paper P (recording medium) while moving in a direction orthogonal to the direction in which the recording paper P is carried. Moreover, the carriage 2 is structured to be movable up to a retracting position which is on a further outside in a width direction (left and right direction in FIG. 1), of an area in which the recording paper P is transported. Moreover, a nozzle cap 60 is installed at this retracting position, and this nozzle cap 60 is driven up and down by a cap driving section 55 (refer to FIG. 20). When the ink is not (to be) jetted from a nozzle 52 (refer to FIG. 18), the ink-jet head 1 and the carriage 2 move integrally to the retracting position. At the retracting position, the nozzle cap 60 is mounted on the ink-jet head 1 to cover from a lower side, a lower surface of the ink-jet head 1 (ink jetting surface 1*a*) in which discharge ports 52*a* of a plurality of nozzles 52 are arranged.

Figure 18:
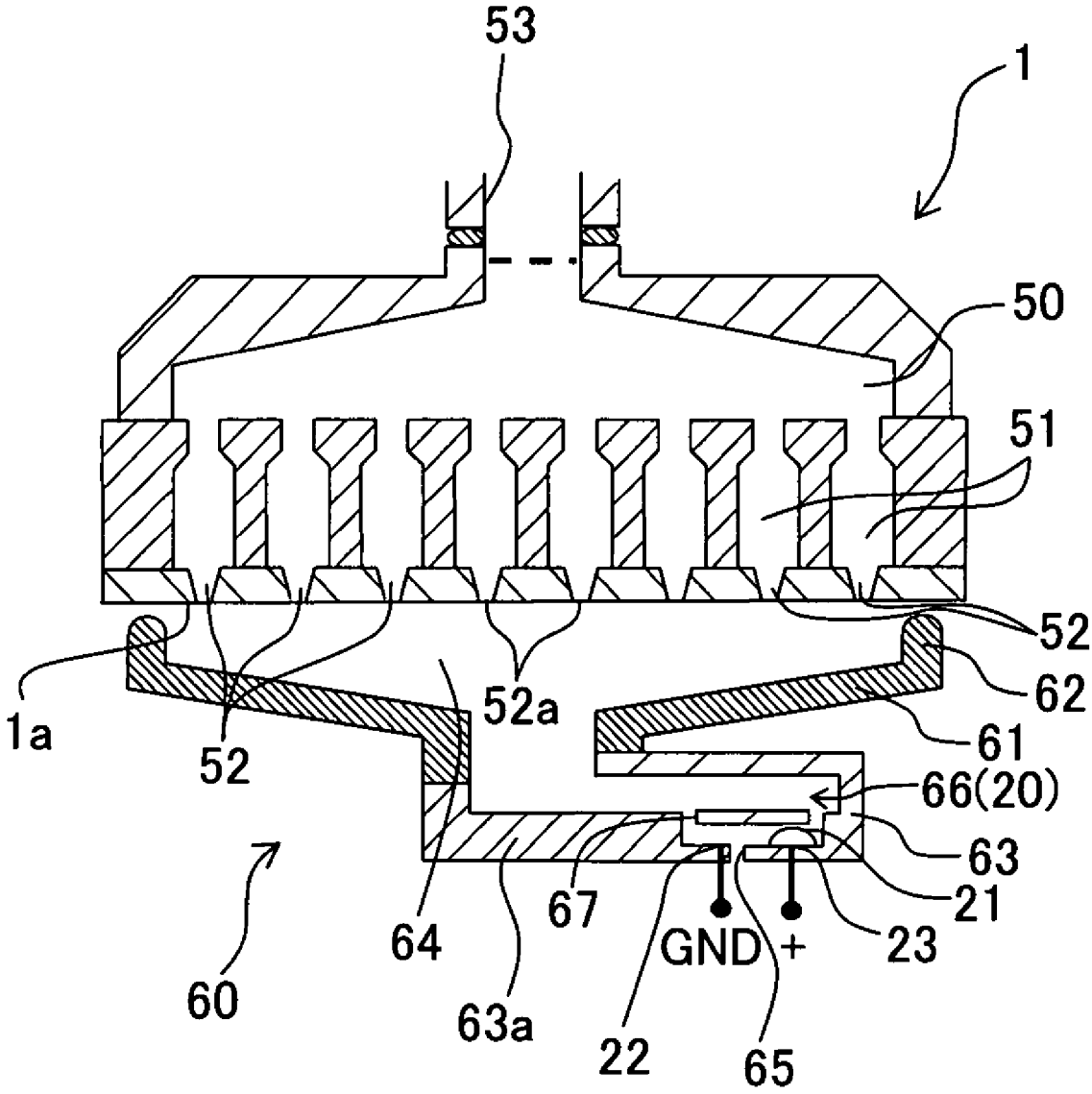
FIG. 18 is a cross-sectional view of an ink-jet head and a nozzle cap (immediately before mounting the nozzle cap) according to a second embodiment.

As shown in FIG. 18, the ink-jet head 1 includes a manifold 50, a plurality of individual channels 51 which are branched from the manifold 50, and the plurality of nozzles 52, which are provided at an end of the individual channels 51 respectively, and which open in the lower surface (ink jetting surface 1*a*) of the ink-jet head 1. The ink is supplied to the manifold 50 from an external ink tank (omitted in the diagram) via an ink supply hole 53 provided at an upper side of the manifold 50. Moreover, the ink is supplied from the manifold 50 to the nozzles 52 via the individual channels 51, and the ink is jetted from the nozzles 52.

The nozzle cap 60 includes a cap 61 which covers the nozzles 52 from the lower side, a lip 62 having a ring shape, which extends upward from a peripheral portion of the cap portion 60, and is in contact with the ink jetting surface 1*a*, and a base 63 which supports the cap 61 from a lower side.

The cap 61 has an area more than an area of the ink jetting surface 1*a* in which the discharge ports 52*a* are arranged, such that it is possible to cover at a time, all the discharge ports 52*a* of the nozzles 52 from the lower side. Moreover, the lip 62 is in contact throughout, around the area of the ink jetting surface 1*a* in which the discharge ports 52*a* are arranged, and is capable of sealing the discharge ports 52*a*. The cap 61 and the lip 62 are formed of an elastic material such as a synthetic resin material.

A communication hole 65 (communication passage) in the form of a through hole which communicates an internal space 64 (a space on a side of the ink jetting surface 1*a*) of the cap 61 and an outside (atmosphere) penetrates a bottom wall 63*a* (base material) of the base 63. This communication hole 65 is for relieving a rise in pressure in the internal space 64, and preventing a meniscus in the nozzle 52 from being destroyed at the time of mounting the nozzle cap 60. However, even when the nozzle cap 60 is mounted, if the internal space 64 communicates with outside, the ink in the nozzle 52 dries with the elapsing of time. Therefore, a valve 66 which opens and closes the communication hole 65 is provided to the base 63.

Figure 19A:
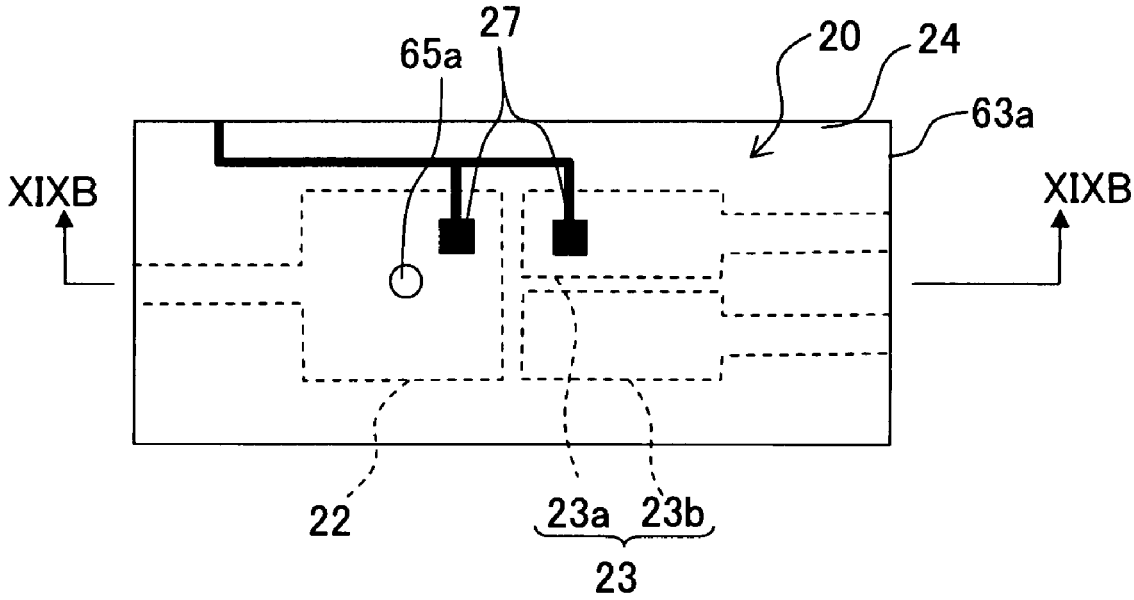
FIG. 19A is a plan view showing a liquid droplet transporting section according the second embodiment.
Figure 19B:
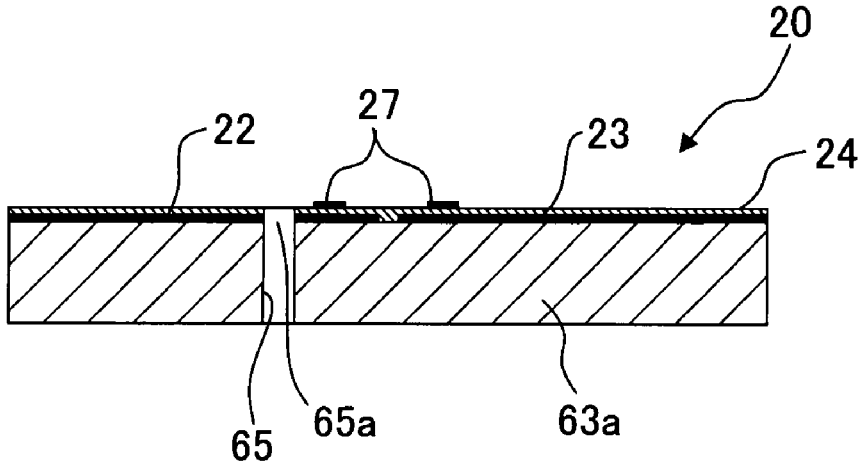
FIG. 19B is a cross-sectional view taken along a line XIXB-XIXB in FIG. 19A.

This valve 66 has a structure almost similar to the valve 11 (refer to FIG. 2 and FIG. 3) of the first embodiment. In other words, the valve 66 includes the liquid droplet transporting section 20 which transports an electroconductive liquid droplet 21, on an inner surface (upper surface) of the bottom wall 63*a*. As shown in FIG. 19, this liquid droplet transporting section 20 includes the first electrode 22 which is arranged on an inner surface (upper surface) of the bottom wall 63*a* to surround an upper end opening 65*a* of the communication hole 65, the second electrode 23 which is arranged on the same upper surface of the bottom wall 63*a*, apart from the first electrode 22, and the insulating layer 24 which is formed on the upper surface of the bottom wall 63*a*, to cover completely (entirely) both the first electrode 22 and the second electrode 23. Moreover, the second electrode 23 is divided into two split electrodes 23*a* and 23*b* arranged to be isolated mutually. At the upper side of the liquid droplet transporting section 20, a protective section 67 which prevents the ink mist from falling directly on the electroconductive liquid droplet 21, is provided.

When the electric potential applying section 25 applies different electric potential (predetermined electric potential or ground electric potential) to each of the first electrode 22 and the second electrode 23, based on the command from the control unit 4 (valve control section 69) of the ink-jet printer 100, the liquid repellent property on the area at which one of the electrodes is arranged, is declined. Therefore, the liquid droplet 21 is transported between the two areas at which the electrodes are arranged. Moreover, when the liquid droplet 21 is transported to the area at which the first electrode 22 is arranged, the communication hole 65 is closed by the liquid droplet 21, and when the liquid droplet 21 is transported to the area at which the second electrode is arranged, the communication hole 65 is opened.

Furthermore, the two split electrodes 23*a* and 23*b* of the second electrode 23 are connected to the liquid droplet position detector 26. The liquid droplet position detector 26 detects whether the liquid droplet 21 exists on the area at which the first electrode 22 is arranged or on the area at which the second electrode 23 is arranged (in other words, the open or closed state of the communication hole 65), based on the electrostatic capacitance between the two split electrodes 23*a* and 23*b*.

Figure 20:
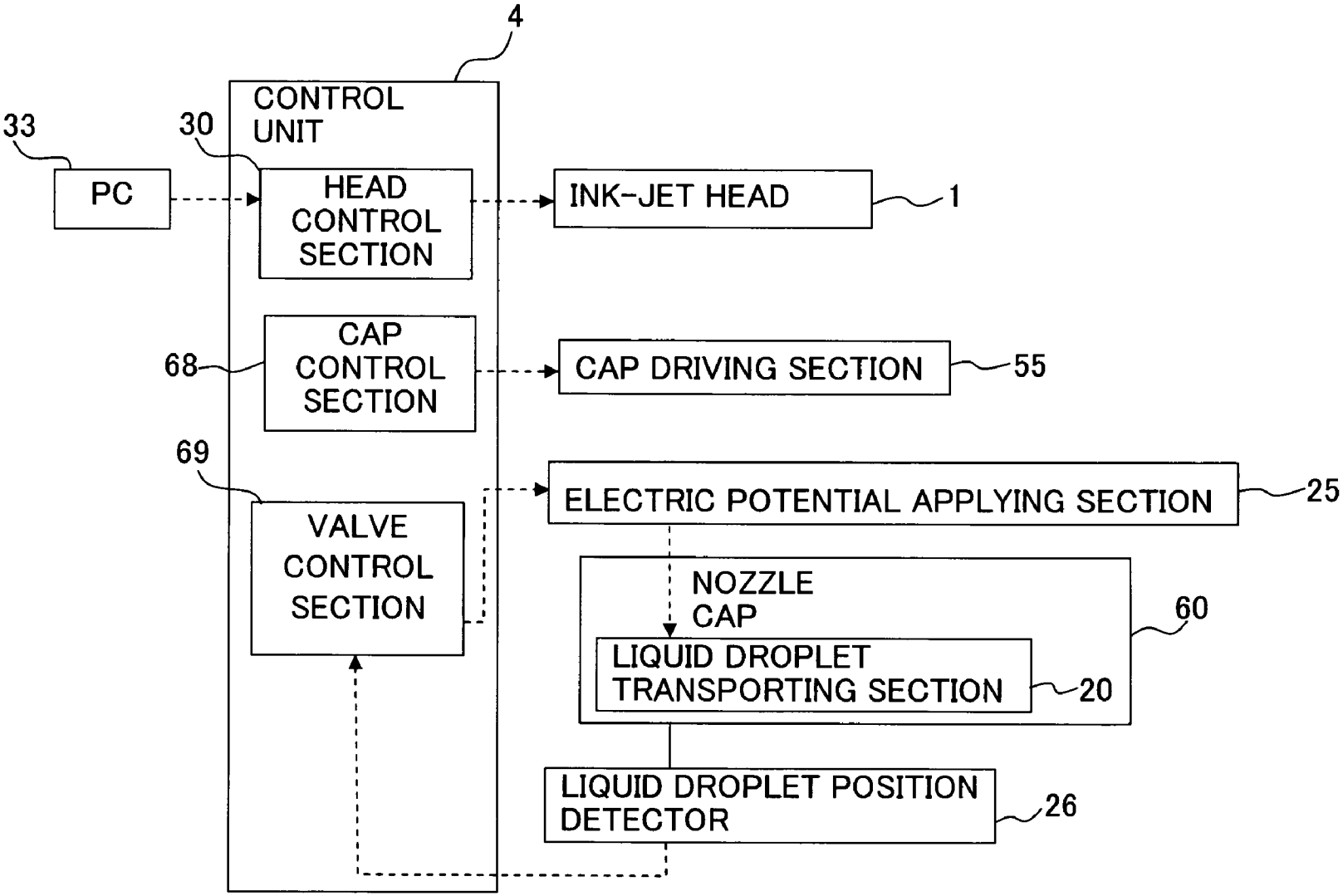
FIG. 20 is a block diagram showing an electrical structure of an ink-jet printer of the second embodiment.

As shown in FIG. 20, the control unit 4 of the ink-jet printer 100 includes the CPU, the RAM, the ROM, and the like. Moreover, the control unit 4 includes the control section 30 which controls the ink-jet head 1 to jet the ink, based on the printing data which is input from the PC 33, a cap control section 68 which controls the cap driving section 55 to make the nozzle cap 60 ascend and descend, and the valve control section 69 which opens and closes the valve 66 by controlling the nozzle cap 60.

At the time of mounting the nozzle cap 60 on the ink-jet head 1, the valve control section 69, before mounting the nozzle cap 60, outputs to the electric potential applying section 25, a signal to open the communication hole 65. At this time, the electric potential applying section 25 applies the ground electric potential to the first electrode 22, and the predetermined electric potential to the second electrode 23. As a result, as shown in FIG. 18, the liquid droplet is transported from the first electrode 22 to the second electrode 23, and the communication hole 65 is opened. Therefore, the pressure rise in the internal space 64 in the cap 61 is relieved, and the meniscus formed in the nozzle 52 is prevented from being destroyed.

Figure 21:
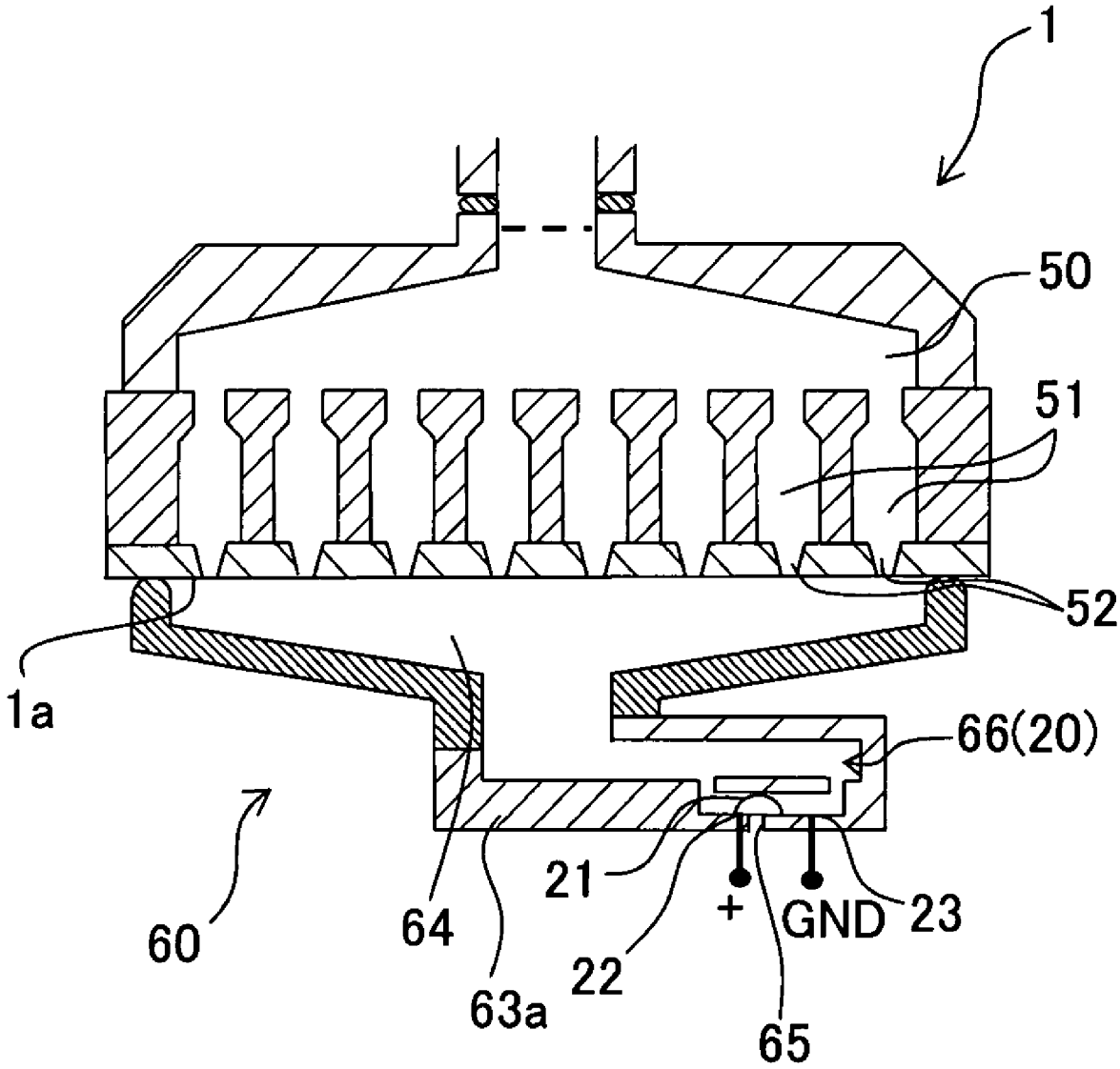
FIG. 21 is a cross-sectional view of the ink-jet head and the nozzle cap (when the nozzle cap is mounted)

On the other hand, after the nozzle cap 60 is mounted on the ink-jet head 1, the valve control section 69 outputs to the electric potential applying section 25, a signal to close the communication hole 65. At this time, the electric potential applying section 25 applies the predetermined electric potential to the first electrode 22, and applies the ground electric potential to the second electrode 23. As a result, as shown in FIG. 21, the liquid droplet 21 is transported from the second electrode 23 to the first electrode 22, and the communication hole 65 is closed by the liquid droplet 21. Therefore, the ink in the nozzle 52 is prevented from being dried.

Furthermore, even when the nozzle cap 60 is removed from the ink-jet head 1 (isolated from the ink jetting surface 1*a*), the valve control section 69, immediately before the nozzle cap 60 is removed, may output to the electric potential applying unit 25 a signal to open the communication hole 65. In this case, it is possible to reduce a pressure fluctuation in the internal space 64 in the cap 61 when the nozzle cap 60 is separated from the ink jetting surface 1*a*. Therefore, the destruction of the meniscus is further prevented.

According to the structure of the second embodiment described above, it is possible to prevent the drying of the ink and destruction of the meniscus, by the liquid droplet transporting section 20 having a simple structure formed by the first electrode 22, the second electrode 23, and the insulating layer 24. Moreover, since the second electrode 23 is divided into two split electrodes 23*a* and 23*b* arranged to be isolated mutually, it is possible to detect by the liquid droplet position detector 26, whether the liquid droplet 21 exists on the area at which the first electrode 22 is arranged or on the area at which the second electrode 23 is arranged, based on the electrostatic capacitance between the two split electrodes 23*a* and 23*b*.

Even in the second embodiment, it is possible to make modifications similar to the modifications made in the first embodiment, in the liquid droplet transporting section 20 (such as division of electrodes and addition of the liquid repellent films 40 and 41 (refer to FIG. 13 to FIG. 17)).

Third Embodiment

Next, third embodiment of the present invention will be described below. This third embodiment is an example in which, the present invention is applied to a memory which is a rewritable non-volatile memory.

Figure 22A:
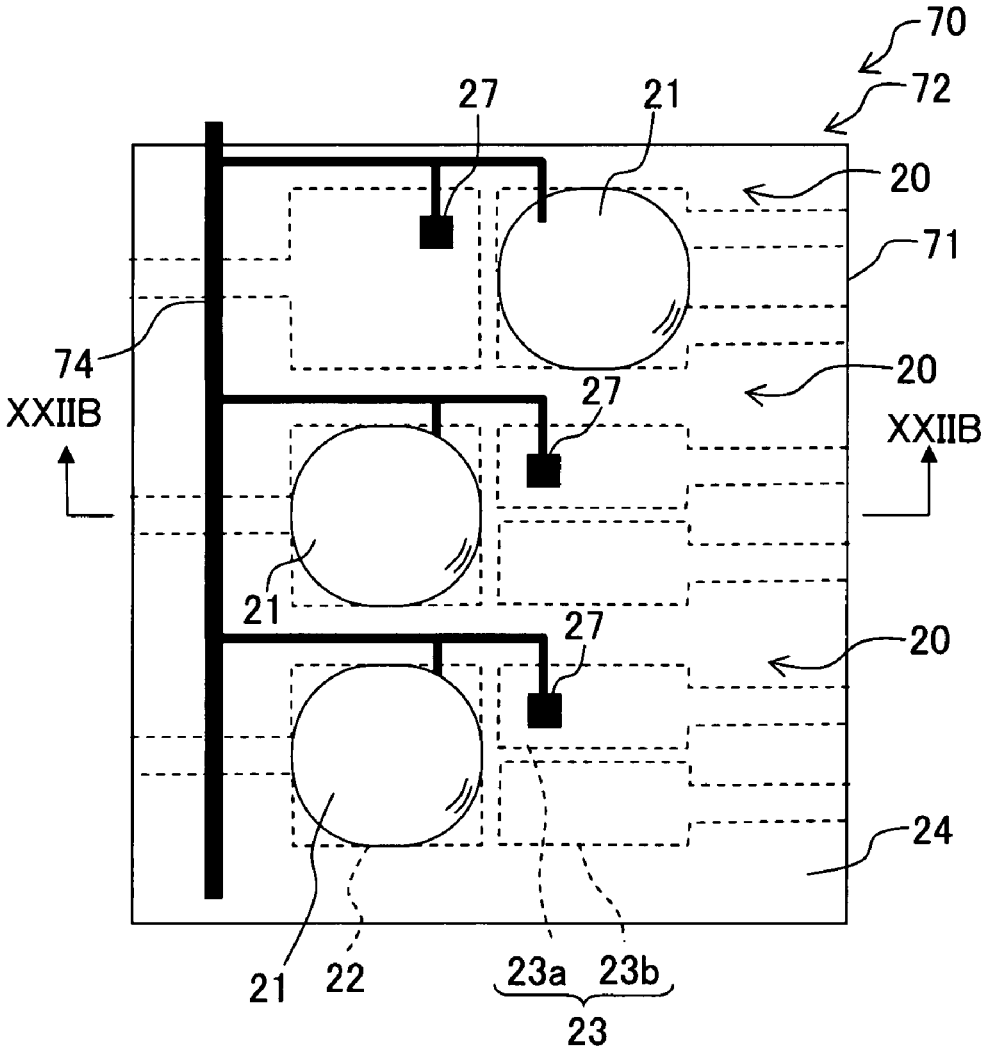
FIG. 22A is a partial plan view of a memory according to a third embodiment.
Figure 22B:
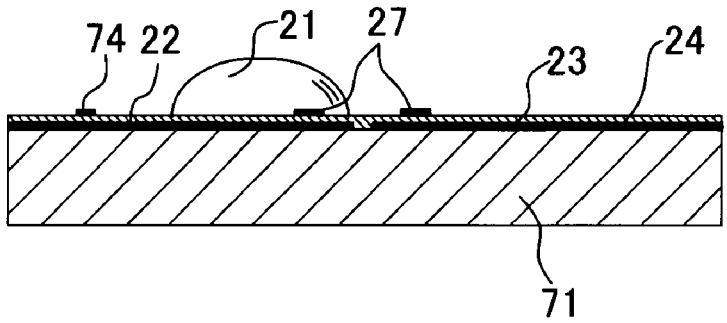
FIG. 22B is a cross-sectional view taken along a line XXIIB-XXIIB in FIG. 22A.
Figure 23:
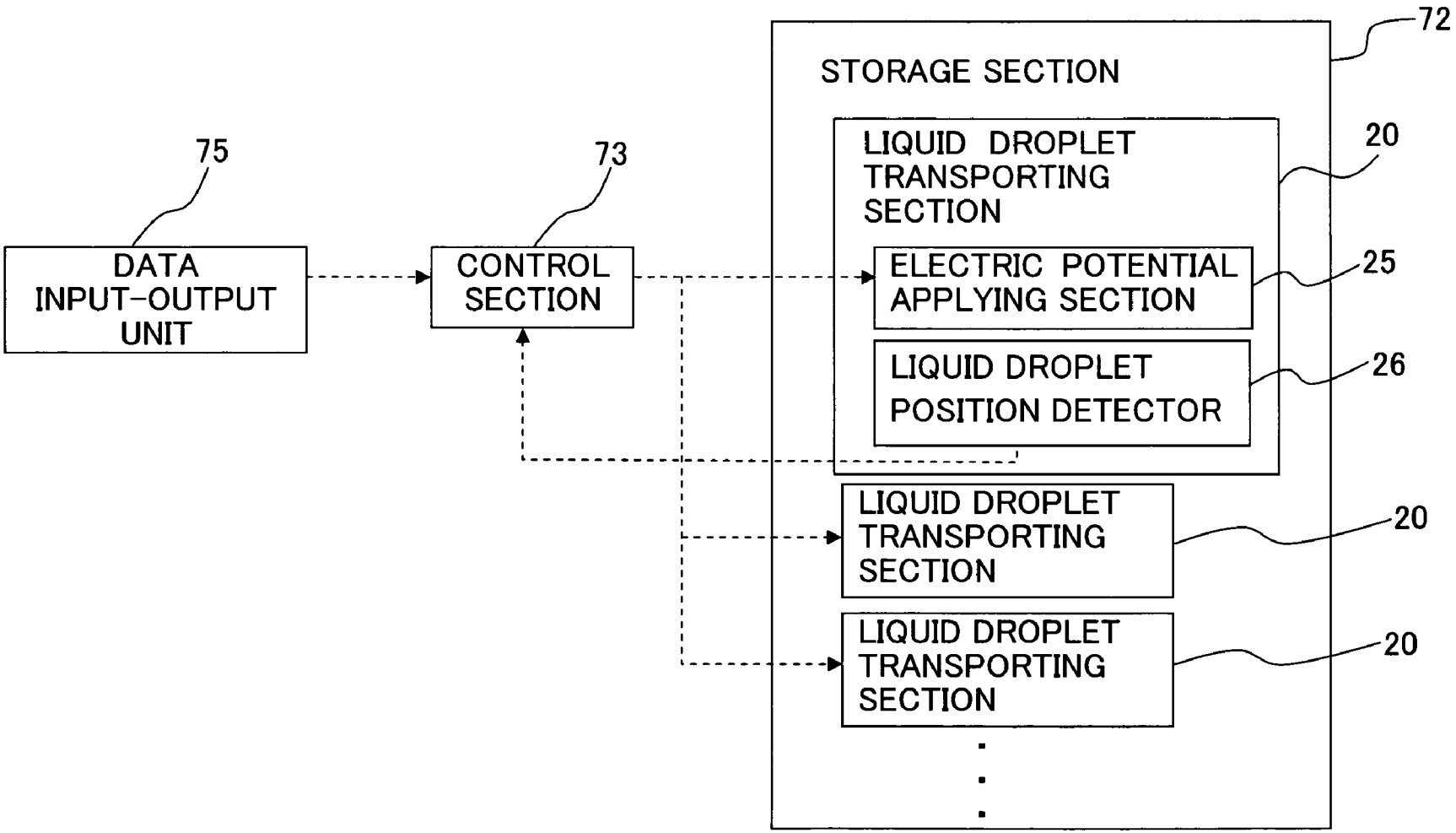
FIG. 23 is a block diagram showing an electrical structure of the memory of the third embodiment.

As shown in FIG. 22A and FIG. 22B, a memory 70 includes a substrate 71 (base material) made of a synthetic resin material, a storage section 72 capable of storing a plurality of bit data, which is formed by a plurality of liquid droplet transporting sections 20 transporting an electroconductive liquid droplet 21, across two areas on a surface of the substrate 71, and a control section 73 which controls each of the liquid droplet transporting sections 20 (refer to FIG. 23). In FIG. 22A, three out of the plurality of liquid droplet transporting sections 20 are shown.

Each liquid droplet transporting section 20 of the storage section 72 has almost a similar structure as in the first embodiment. In other words, as shown in FIG. 22A and FIG. 22B, the liquid droplet transporting section 20 includes the first electrode 22 which is arranged on the surface of the substrate 71 made of a synthetic resin material, the second electrode 23 which is arranged apart from the first electrode 22 on the surface of the substrate 71 same as the first electrode 22, and the insulating layer 24 which is formed on the surface of the substrate 71, to cover completely both the first electrode 22 and the second electrode 23. Moreover, the second electrode 23 is divided into two split electrodes 23*a* and 23*b* arranged to be isolated mutually. Furthermore, the ground electrode 27 is formed on the surface of the insulating layer 24, in each of the area at which the first electrode 22 is arranged, and the area at which the second electrode 23 is arranged. The ground electrodes 27 of the plurality of liquid droplet transporting sections 20 are brought into conduction via a wire 74, and all the ground electrodes 27 are kept all the time at the ground electric potential.

Moreover, as shown in FIG. 23, each liquid droplet transporting section 20 includes the electric potential applying section 25 which applies the electric potential to the first electrode 22 and the second electrode 23, and the liquid droplet position detector 26. The electric potential applying section 25 applies different electric potential (predetermined electric potential or ground electric potential) to each of the first electrode 22 and the second electrode 23, according to the data which is to be stored, and transports the liquid droplet 21 between the two areas at which the electrodes (the first electrode 22 and the second electrode 23) are arranged. Concretely, a state in which the liquid droplet 21 exists on the area at which the first electrode 22 is arranged (state of the two liquid droplet transporting sections 20 on a lower side in FIG. 22A) corresponds to "0" of the bit data, and a state in which the liquid droplet 21 exists on the area at which the second electrode 23 is arranged (state of the liquid droplet transporting section 20 on an uppermost side in FIG. 22A) corresponds to "1" of the bit data. Furthermore, in one liquid droplet transporting section 20, it is possible to store data of 1-bit (one bit) ("0" or "1") by transporting the liquid droplet 21 to one of the two areas at which the electrodes (the first electrode 22 and the second electrode 23) are arranged, Moreover, the liquid droplet position detector 26 detects whether the liquid droplet 21 exists on the area at which the first electrode 22 is arranged or on the area at which the second electrode 23 is arranged (in other words, which of "0" and "1" is stored), based on the electrostatic capacitance between the two split electrodes 23*a* and 23*b*, and outputs the result of detection to the control section 73.

As shown in FIG. 23, the control unit 73 is connected to an external data input-output unit 75. When a plurality of bit data to be stored is input to the control section 73 from the data input-output unit 75, the control section 73 outputs information related to the bit data ("0" or "1") which is to be stored to the electric potential applying section 25 of the plurality of liquid droplet transporting sections 20 corresponding to each of the plurality of bit data. Moreover, when the data to be stored is "0", the electric potential applying section 25 applies the predetermined electric potential to the first electrode 22, and at the same time applies the ground electric potential to the second electrode 23, and transports the liquid droplet 21 to the area at which the first electrode 22 is arranged (the two liquid transporting sections 20 at the lower side in FIG. 22A). On the other hand, when the data to be stored is "1", the electric potential applying section 25 applies the ground electric potential to the first electrode 22, and at the same time applies the predetermined electric potential to the second electrode 23, and transports the liquid droplet 21 to the area at which the second electrode 23 is arranged (the liquid droplet transporting section 20 at the uppermost side in FIG. 22A). In this manner, the plurality of bit data which is input is stored in the storage section 72. When the transporting of the liquid droplet 21 is over, the electric potential of both the first electrode 22 and the second electrode 23 is switched to the ground electric potential, and since this state is maintained, the data which is stored is not erased even when a power supply of the memory 70 is switched off.

Moreover, information as to whether the liquid droplet 21 exists on the area at which the first electrode 22 is arranged or on the area at which the second electrode 23 is arranged is input to the control section 73 from the liquid droplet position detector 26 of the plurality of liquid droplet transporting sections 20. In other words, the control section 73 is capable of detecting as to which data of "0" and "1" is stored by one liquid droplet transporting section 20 of the storage section 72. Moreover, the control section 73 reads the data stored in the storage section 72, according to a request from the data input-output unit 75, and outputs to the data input-output unit 75.

According to a structure in the third embodiment described above, it is possible to store the data of 1-bit (one bit) by the liquid droplet transporting section 20 having a simple structure formed by the two electrodes 22 and 23 (the first electrode 22 and the second electrode 23), and the insulating layer 24. Moreover, since the second electrode 23 is divided into two split electrodes 23*a* and 23*b* arranged to be isolated mutually, it is possible to detect by the liquid droplet position detector 26, whether the liquid droplet 21 exists on the area at which the first electrode 22 is arranged or on the area at which the second electrode 23 is arranged, based on the electrostatic capacitance between the two split electrodes 23*a* and 23*b*. Consequently, it is possible to determine a data of 1-bit (one bit) which is stored, and to read the data. Furthermore, since the memory 70 according to the third embodiment uses a substrate made of a synthetic resin instead of a silicon substrate used in a normal semiconductor memory, it is possible to manufacture the memory 70 at a low cost.

Even in the third embodiment, it is possible to make modifications similar to the modifications made in the first embodiment, in the liquid droplet transporting section 20 (such as addition of the liquid repellent films 40 and 41 (refer to FIG. 13 to FIG. 17)). However, for reading the data which is already stored in the storage section 72, the minimum requirement is that at least one of the first electrode 22 and the second electrode 23 is divided into a plurality of split electrodes, and it is possible to detect whether the liquid droplet 21 exists on the area at which the first electrode 22 is arranged or on the area at which the second electrode 23 is arranged. In the third embodiment, the memory 70 is capable of storing bit data (two values (binary data) "0" and "1"), and by arranging a plurality of split electrodes each divided as the second electrode in an arrangement direction of the first electrode 22 and the second electrode 23, the memory 70 is capable of storing multi-valued information such as three-valued (ternary data) information or higher-valued information.

Fourth Embodiment

Next, a fourth embodiment of the present invention will be described below. The fourth embodiment is an example in which the present invention is applied to a display unit which displays the desired characters, images, and the like.

As shown in FIG. 24, a display unit 80 includes a substrate 81, a display section 82 which is formed of the plurality of liquid droplet transporting sections 20 each transporting an electroconductive and colored liquid droplet 21 across two areas on a surface of the substrate 81 (base material), a cover plate 83 which is arranged facing the surface of the substrate 81, and a control section 84 (refer to FIG. 25) which controls each of the liquid droplet transporting sections 20 of the display section 82. In FIG. 24, three of the plurality of liquid droplet transporting sections 20, are shown.

Each liquid droplet transporting section 20 of the display section 82 has almost a similar structure as in the first embodiment. In other words, as shown in FIG. 24, the liquid droplet transporting section 20 includes the first electrode 22 which is arranged on the surface of the substrate 81, the second electrode 23 which is arranged apart from the first electrode 22 on the surface of the substrate 81 same as the first electrode 22, and the insulating layer 24 which is formed on the surface of the substrate 81, to cover completely both the first electrode 22 and the second electrode 23. Moreover, the second electrode 23 is divided into two split electrodes 23*a* and 23*b* arranged to be isolated mutually. Furthermore, the ground electrode 27 is arranged on the surface of the insulating layer 24, in each of the area at which the first electrode 22 is arranged, and the area at which the second electrode 23 is arranged. The ground electrodes 27 of the plurality of liquid droplet transporting sections 20 are brought into conduction via a wire 85, and all the ground electrodes 27 are kept all the time at the ground electric potential.

Figure 25:
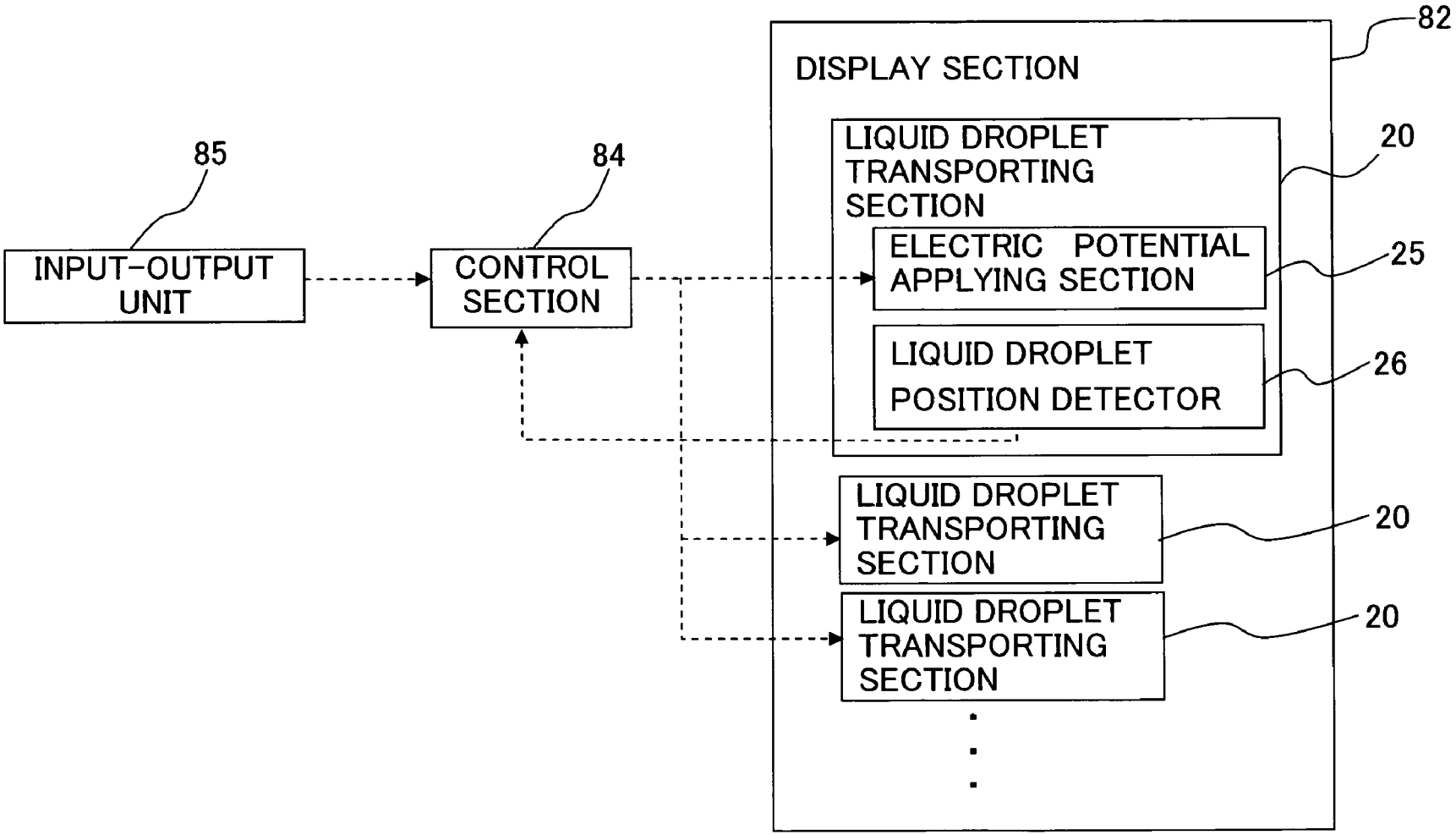
FIG. 25 is a block diagram showing an electrical structure of the display unit of the fourth embodiment.

Moreover, as shown in FIG. 25, each liquid droplet transporting section 20 includes the electric potential applying section 25 which applies the electric potential to the first electrode 22 and the second electrode 23, and the liquid droplet position detector 26. The electric potential applying section 25, based on a command from the control section 84, applies different electric potential (predetermined electric potential or ground electric potential) to each of the first electrode 22 and the second electrode 23, and transports the liquid droplet 21 between the two areas at which the electrodes (the first electrode 22 and the second electrode 23) are arranged. Moreover, the liquid droplet position detector 26 detects whether the liquid droplet 21 exists on the area at which the first electrode 22 is arranged or on the area at which the second electrode 23 is arranged, based on the electrostatic capacitance between the two split electrodes 23*a* and 23*b*, and outputs the result of detection to the control section 84.

Figure 24A:
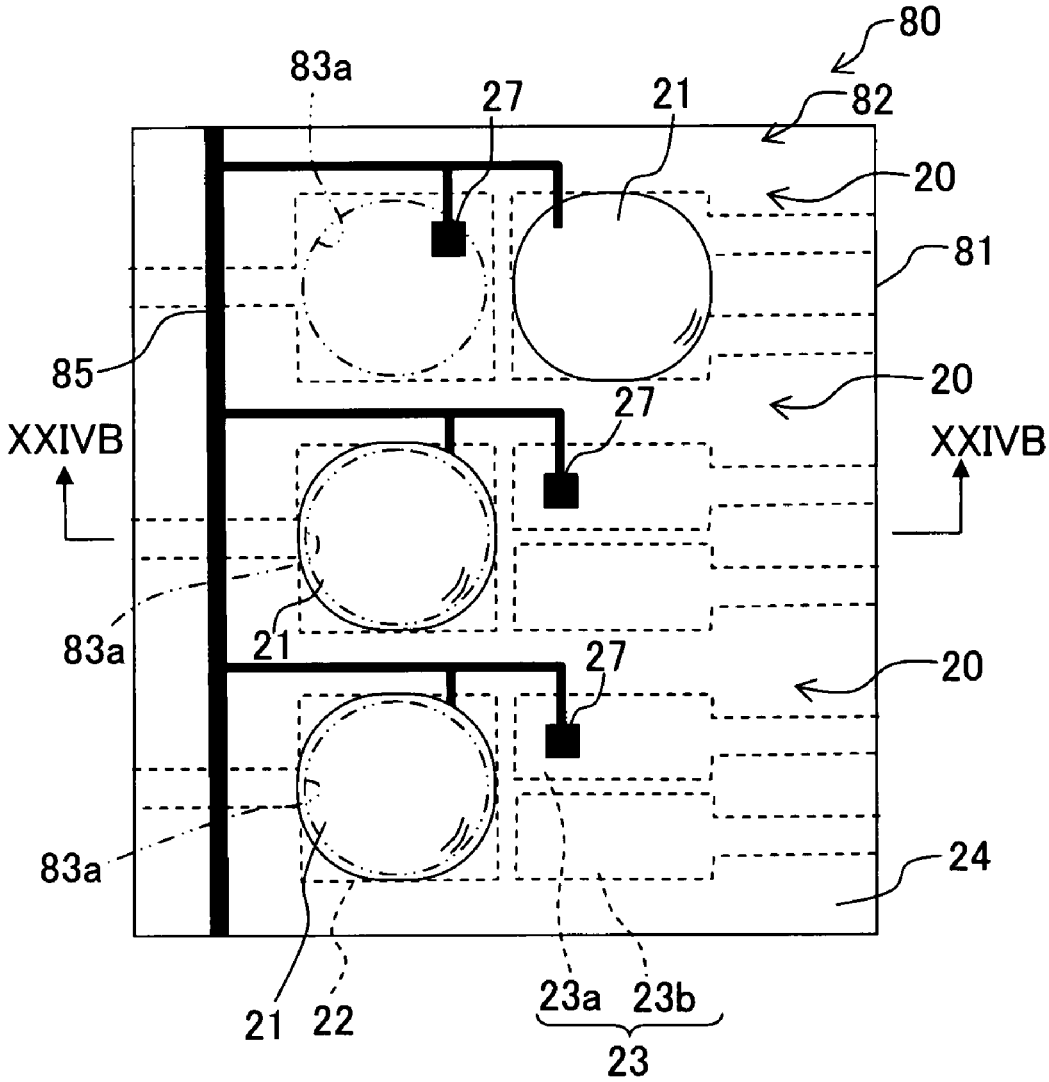
FIG. 24A is a partial plan view of a display unit according to a fourth embodiment.
Figure 24B:
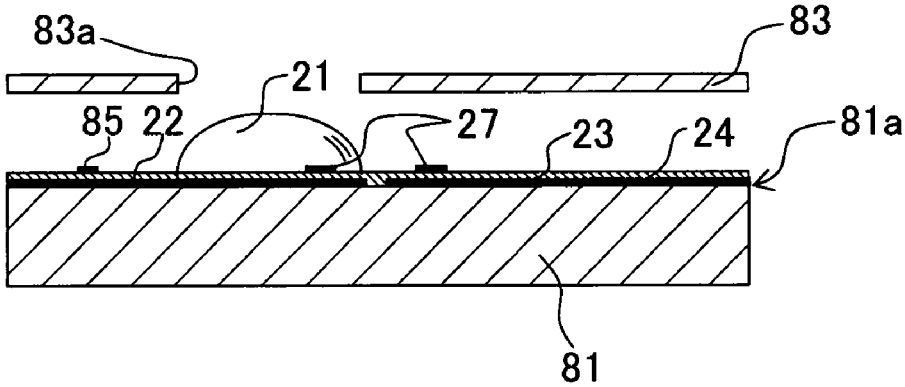
FIG. 24B is a cross-sectional view taken along a line XXIVB-XXIVB in FIG. 24A.

As shown in FIG. 24, the cover plate 83 faces a surface of the substrate 81 on which the first electrode 22 and the second electrode 23 are arranged. Moreover, a transit hole (through hole) 83*a* in the form of a through hole penetrates the cover plate 83 at a position facing the first electrode 22. Therefore, when viewed from a side of the cover plate 83 opposite to the substrate 81, the area at which the first electrode 22 is arranged is seen through the transit hole 83*a*, but the area at which the second electrode 23 is arranged is blocked by the cover plate 83. Consequently, in a state in which the color liquid droplet 21 exists on the area at which the first electrode 22 is arranged (state of the two liquid droplet transporting sections 20 at the lower side in FIG. 24A), the color of the liquid droplet 21 is displayed, but in a state in which the color liquid droplet 21 exists on the area at which the second electrode 23 is arranged (state of the liquid droplet transporting section 20 at the upper side in FIG. 22A), the color of the liquid droplet 21 is not displayed, and a color (such as a white color) of the insulating layer 24 which is a base material is displayed.

As shown in FIG. 25, the control section 84 is connected to an external input unit 85. Moreover, when data related to the characters, images, and the like which are to be displayed is input from the input unit 85 to the control section 84, the control section 84 outputs a signal to display to the electric potential applying section 25 of the liquid droplet transporting section 20 corresponding to the characters, images, and the like to be displayed, from among the plurality of liquid droplet transporting sections 20 of the display section 82. As a result, the electric potential applying unit 25 of the liquid droplet transporting section 20 to which the signal is input, applies the predetermined electric potential to the first electrode 22, and at the same time applies the ground electric potential to the second electrode 23, and transports the liquid droplet 21 to the area at which the first electrode 22 is arranged. At this time, the color of the liquid droplet 21 which is transported to the area at which the first electrode 22 is arranged is displayed through the transit hole 83*a* in the cover plate 83.

Moreover, position information of the liquid droplet 21 which is detected by the liquid droplet position detector 26 is input to the control section 84. Therefore, the control section 84 is capable of identifying the characters, images, and the like which are displayed practically, by the position information of this liquid droplet 21.

According to the structure of the fourth embodiment described above, it is possible to display the desired characters, images, and the like by the liquid droplet transporting section 20 having a simple structure formed by the two electrodes 22 and 23 (the first electrode 23 and the second electrode 23), and the insulating layer 24. Moreover, since the second electrode 23 is divided into two split electrodes 23*a* and 23*b* arranged to be isolated mutually, it is possible to detect whether the liquid droplet 21 exists on the area at which the first electrode 22 is arranged or on the area at which the second electrode 23 is arranged, and to identify the characters, images, and the like which are practically displayed. Furthermore, the liquid droplet 21 does not move from the area at which the first electrode 22 is arranged or the area at which the second electrode 23 is arranged, unless different electric potential is applied to the first electrode 22 and the second electrode 23. In other words, when the liquid droplet 21 exists on the area at which the first electrode 22 is arranged, and the color of the liquid droplet is displayed, since the liquid droplet 21 does not move to the area at which the second electrode 23 is arranged unless the electric potential applied to the first electrode 22 and the electric potential applied to the second electrode 23 is different, the display state is maintained. Moreover, when the liquid droplet 21 exists on the area at which the second electrode 23 is arranged, and the color of the liquid droplet is not displayed, the liquid droplet does not move to the area in which the first electrode 22 is arranged unless the electric potential applied to the first electrode 22 and the electric potential applied to the second electrode 23 are different, and the state in which the color of the liquid droplet is not displayed is maintained. In other words, for maintaining the same display condition, it is not necessary to supply the power supply all the time (continuously). Consequently, it is possible to maintain the same display state without consuming the electric power.

Even in the fourth embodiment, it is possible to make modifications similar to the modifications made in the first embodiment, in the liquid droplet transporting section 20 (such as division of electrodes and addition of the liquid repellent films 40 and 41 (refer to FIG. 13A to FIG. 17B)).

In addition to these modifications, it is possible to make further modifications such as following in the fourth embodiment described above. For example, when the cover plate is arranged to face only the area in which the second electrode 23 is arranged, and does not face the area in which the first electrode 22 is arranged, the transit hole 83*a* is not required to be formed in the cover plate 83.

Moreover, when the first electrode 22 and the second electrode 23 are formed of a transparent ITO (indium-tin oxide) thin film, the insulating layer 24 is formed of an almost transparent fluororesin, and the substrate 81 is formed of a transparent material such as glass, the color of the liquid droplet 21 is displayed even when seen from a surface of the substrate 81 on the side opposite to the electrodes 22 and 23. Therefore, in such case, the cover plate 83 may be arranged to face the surface of the substrate 81 on the side opposite to the electrodes 22 and 23 (lower side of the substrate 81 in FIG. 24B).

Furthermore, the first electrode 22, a portion of the substrate 81 in the area in which the first electrode 22 is arranged, and a portion of the insulating layer 24 in the area in which the first electrode 22 is arranged may be transparent, and on the other hand, at least one of the second electrode 23, a portion of the substrate 81 in the area at which the second electrode 23 is arranged, and a portion of the insulating layer 24 in the area at which the second electrode 23 is arranged may be non-transparent (property of not letting light to pass through). In this structure, since the area at which the second electrode 23 is arranged is non-transparent, when viewed from the side of the substrate 81 opposite to the electrodes 22 and 23 (lower side of the substrate 81 in FIG. 24B), the liquid droplet 21 which exists on the area at which the second electrode 23 is arranged is not seen, and therefore, the cover plate 83 is not necessary.

In the embodiments and the modifications described above, the description is made by giving examples of specific shapes, structures, and materials of the electrodes and the substrate. However, the present invention is not restricted to these shapes, structures, and materials, and it is possible to use arbitrary shapes, structures, and materials, provided that an effect of the present invention is achieved. The embodiments and the modifications described above are examples in which the present invention is applied to a valve or the like used in an ink-jet cartridge. However, embodiments to which the present invention is applicable are not restricted to these embodiments and the modifications. The liquid droplet transporting apparatus or the valve of the present invention is also applicable to a fluid supplying apparatus which supply a gas and a fluid used in micro robots and medical equipments.

What is claimed is:

1. A liquid droplet transporting apparatus, comprising:

a first electrode which is arranged on a surface of a substrate;

a second electrode which is arranged apart from the first electrode on the surface of the substrate;

an insulating layer which is arranged to cover both the first electrode and the second electrode, a liquid repellent property on a surface of the insulating layer being changed according to an electric potential difference between the first and second electrodes and an electroconductive liquid droplet on the surface; and a third electrode which cooperates with the second electrode to detect a presence of the liquid droplet on the second electrode.

2. The liquid droplet transporting apparatus according to claim 1;

wherein at least one of the first electrode and the second electrode is divided as at least two split electrodes which are arranged to be mutually isolated on the surface of the substrate.

3. The liquid droplet transporting apparatus according to claim 2;

wherein one of the two split electrodes is the third electrode.

4. The liquid droplet transporting apparatus according to claim 2;

wherein the split electrodes are arranged such that when the liquid droplet is transported to an area in which the split electrodes are arranged, the liquid droplet is positioned between the split electrodes while making a contact with both of the split electrodes; and wherein the liquid droplet transporting apparatus further comprises a liquid droplet position detector which detects whether the liquid droplet exists on an area at which the first electrode is arranged or on an area at which the second electrode is arranged based on an electrostatic capacitance between the split electrodes.

5. The liquid droplet transporting apparatus according to claim 1, further comprising:

an electric potential applying mechanism which applies an electric potential to each of the first electrode and the second electrode;

wherein the liquid droplet is transported in the insulating layer between portions thereof covering the first electrode and the second electrode respectively, by applying different electric potential to the first electrode and the second electrode respectively with the electric potential applying mechanism to reduce a liquid repellent property on the surface of the insulating layer at a portion among the portions covering one of the first and second electrodes to be lower than a liquid repellent property of another portion covering the other of the first and second electrodes.

6. The liquid droplet transporting apparatus according to claim 1;

wherein ground electrodes are arranged on the surface of the insulating layer at portions thereof covering the first electrode and the second electrode respectively.

7. The liquid droplet transporting apparatus according to claim 1;

wherein the third electrode is isolated from the surface of the substrate, and extends to face the second electrode.

8. The liquid droplet transporting apparatus according to claim 7;

wherein the third electrode extends to face the second electrode and a part of the first electrode, and is arranged as a ground electrode.

9. The liquid droplet transporting apparatus according to claim 1;

wherein a first liquid repellent film which always has a liquid repellent property not less than the liquid repellent property of the insulating layer, is formed on the surface of the substrate at an area outside the first electrode and the second electrode.

10. The liquid droplet transporting apparatus according to claim 9;

wherein between the first electrode and the second electrode, a width of an area in which the first liquid repellent film is absent is locally narrowed.

11. The liquid droplet transporting apparatus according claim 1;

wherein a second liquid repellent film which always has a liquid repellent property not less than the liquid repellent property of the insulating layer is formed on the surface of the substrate at an area between the first electrode and the second electrode.

12. The liquid droplet transporting apparatus according to claim 11;

wherein a part of the second liquid repellent film is projected toward an area in which each of the first electrode and the second electrode is arranged.

13. A valve comprising:

the liquid droplet transporting apparatus as defined in claim 1;

wherein a fluid passage, which has an opening in an area at which the first electrode is arranged, is formed in the substrate; and wherein the opening of the fluid passage is closed by the liquid droplet when the liquid droplet exists in the area at which the first electrode is arranged, and the opening of the fluid passage is opened when the liquid droplet exists in an area at which the second electrode is arranged.

14. The valve according to claim 13;

wherein the valve is provided on an ink cartridge including an ink accommodating space which accommodates ink, and an atmosphere-communication passage which communicates the ink accommodating space and an atmosphere; and wherein the atmosphere-communication passage is opened and closed by transporting the liquid droplet between the first electrode and the second electrode.

15. The valve according to claim 13;

wherein the valve is provided on a cap which covers an ink jetting surface of an ink-jet head which jets an ink onto a recording medium, and which includes a communication passage which communicates a space defined by the ink jetting surface and the cap, and an outside of the cap; and wherein the communication passage is opened and closed by transporting the liquid droplet between the first electrode and the second electrode.

16. A memory comprising:

the liquid droplet transporting apparatus as defined in claim 1;

wherein the liquid droplet transporting apparatus transports the liquid droplet between the first electrode and the second electrode according to data to be stored in the memory.

17. A display unit comprising:

the liquid droplet transporting apparatus as defined in claim 1; and a cover plate which is arranged to face the surface of the substrate, and which has a through hole which is formed at a position corresponding to the first electrode;

wherein the liquid droplet is a colored liquid, and the liquid droplet transporting apparatus transports the liquid droplet between the first electrode and the second electrode according to data to be displayed on the display unit.

18. A display unit comprising:

liquid droplet transporting apparatus as defined in claim 1;

wherein the first electrode, a portion of the substrate corresponding to the first electrode, and a portion of the insulating layer corresponding to the first electrode are all transparent; and wherein at least one of the second electrode, a portion of the substrate corresponding to the second electrode, and a portion of the insulating layer corresponding to the second electrode is non-transparent.

* * * * *